US005311625A

United States Patent [19]

Barker et al.

[11] Patent Number: 5,311,625

[45] Date of Patent: May 17, 1994

[54] PORTABLE, INTEGRATED, UNIVERSALLY ADJUSTABLE POSITION CONTROL SYSTEM

[75] Inventors: Donald Barker, Sandy Hook; John Hamma, Milford, both of Conn.

[73] Assignee: Truman Products, Abington, Pa.

[21] Appl. No.: 916,636

[22] Filed: Jul. 22, 1992

[51] Int. Cl.[5] ..... A61G 7/06

[52] U.S. Cl. ..... 5/615; 5/453; 417/363; 417/423.14

[58] Field of Search ..... 5/615, 453, 455, 903; 417/363, 423.14

[56] References Cited

U.S. PATENT DOCUMENTS

| | | | |
|---|---|---|---|
| 2,674,405 | 4/1954 | Cawl | 417/363 |
| 2,964,236 | 12/1960 | Kasper | 417/363 |
| 3,199,774 | 8/1965 | Lowell | 417/363 X |
| 3,606,623 | 9/1971 | Aymar | 5/615 X |
| 4,171,190 | 10/1979 | Hudson | 417/363 X |
| 4,309,783 | 1/1982 | Cammack et al. | 5/615 X |
| 4,639,960 | 2/1987 | Quillen et al. | 5/615 X |
| 4,864,683 | 9/1989 | Herron, Jr. et al. | 417/363 X |
| 4,873,731 | 10/1989 | Williamson | 5/453 X |
| 4,941,221 | 7/1990 | Kanzler | 5/615 |
| 4,950,133 | 8/1990 | Sargent | 417/423.14 X |
| 4,978,281 | 12/1990 | Conger, IV | 417/423.14 X |
| 5,170,522 | 12/1992 | Walker | 5/453 X |

*Primary Examiner*—Michael F. Trettel
*Attorney, Agent, or Firm*—Melvin I. Stoltz

[57] ABSTRACT

By providing position control means cooperatively associated with a support pad with said control means being constructed for arcuately moving the support pad in response to activation by the user, with the position control means and pad peripherally surrounded by a cover, a unique, portable, self-contained, unitary, movably adjustable support assembly is attained whereby individuals are able to position the support pad in any desired location or on any surface while also being able to automatically raise and/or lower the support pad to any position for comfort and support. In the preferred embodiment, the movably adjustable support assembly is constructed with expandable shroud means integrally connected with the cover in association with the position control means for expanding in response to the arcuate movement of the position control means while being automatically retracted into a folded configuration when the control means are returned to its original position. In addition, the present invention incorporates a single air flow control assembly which is capable of directly controlling two separate and independent movably adjustable support assemblies, each of which employ separate control means. In this way, individuals with queen or king sized beds are able to employ two separate and independent movably adjustable support assemblies on the single bed for separate and independent control, while employing a single air flow control assembly.

33 Claims, 9 Drawing Sheets

FIG. 6
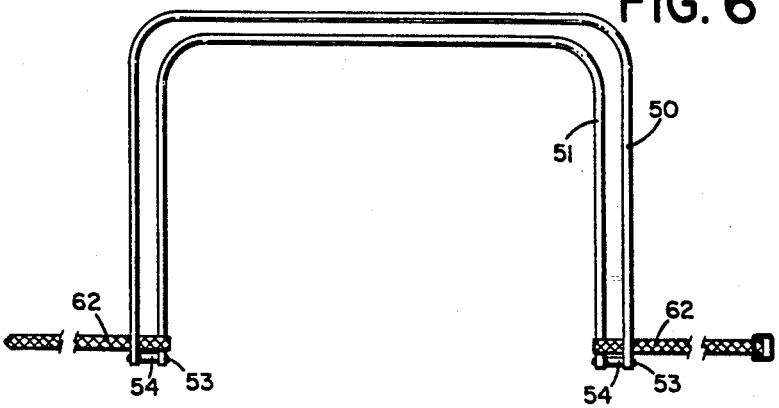
FIG. 7
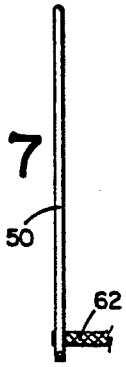
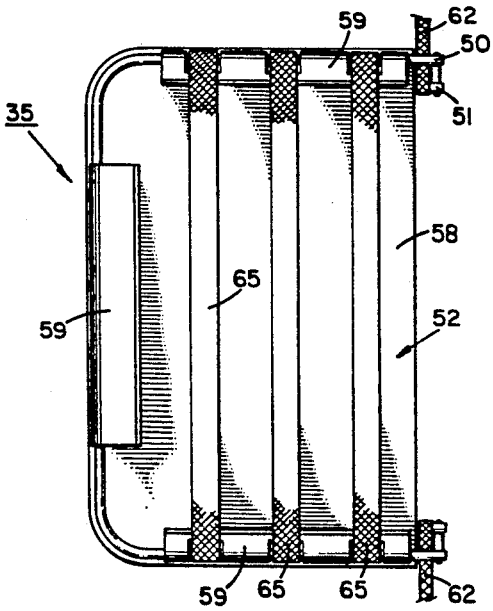
FIG. 8
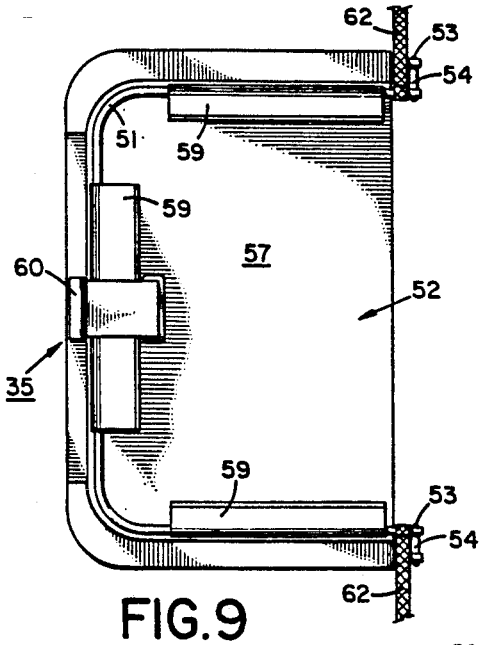
FIG. 9
FIG. 10
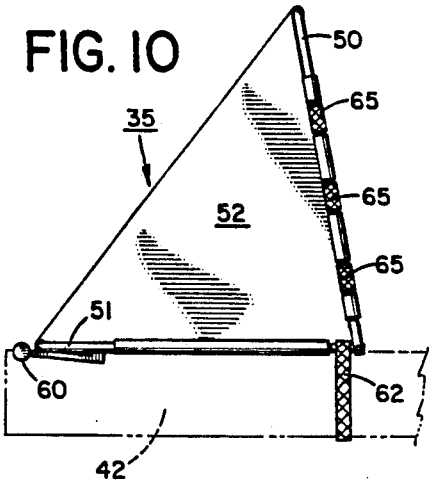
FIG. 11
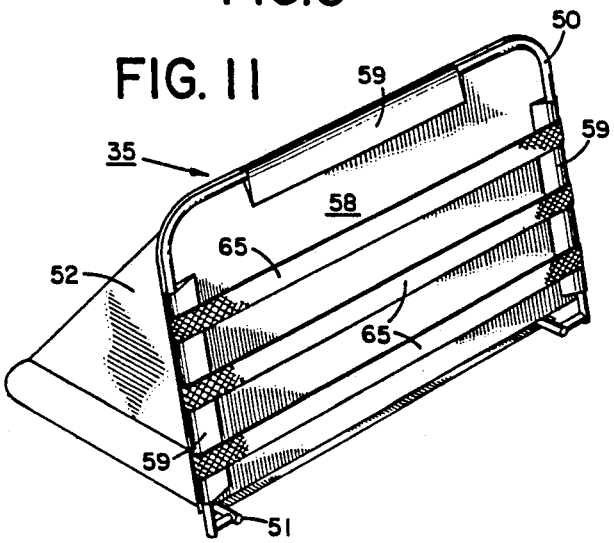

PORTABLE, INTEGRATED, UNIVERSALLY ADJUSTABLE POSITION CONTROL SYSTEM

TECHNICAL FIELD

This invention relates to adjustable support systems and, more particularly, to a universally adjustable, portable self-contained support system enabling multi-position adjusting for both the back and/or legs of the user.

BACKGROUND ART

In order to meet a continuing consumer demand for comfort when individuals are in a prone or lying position, whether lying in bed, on a couch, on a floor, or any other location, numerous prior art constructions have been developed. Typically, these prior art configurations comprise either very expensive, complex movable bed frame constructions or inexpensive, adjustable back rests or fixed position inflation devices. However, no moderately priced system exists which is able to provide the comfort of a bed system, without its cost or complexity while also providing a system which is capable of being used in any desired location.

The inexpensive back rests, while often usable in various locations, merely have fixed positions or movable cushion or pad constructions which attempt to provide comfort by elevating an individual's back at a desired angle to the ground or to the bed on which the structure is mounted. While providing some comfort, these systems are incapable of providing the fullbody support and range of positions which consumer's are seeking. Consequently, although numerous prior art constructions have been developed, none of these prior art cushions, pads, or adjustable back rests, have been capable of satisfying or meeting the consumer's needs and wants.

As an alternate to these back rest constructions, other prior art products have been developed for use in bed to enable the consumer to be partially elevated, with the back of the user supported in order to watch television or read more comfortably. Typically, these constructions employ air-inflation systems which either lie on top of the bed or are placed between the mattress and the box spring. However, these systems have similarly proved to be incapable of meeting the consumer's needs.

In particular, the prior art systems which lie on top of the bed must be removed prior to sleeping due to the bulkiness of the systems and the discomfort caused by the systems when not in use. The air inflation systems constructed for being placed underneath the mattress raise the entire mattress during their use. However, these systems, also, are removed by the consumer when lying flat, due to the discomfort caused by their bulk when not in use. Consequently, these prior art inflation systems have been incapable of meeting the consumer requirements.

Furthermore, these prior art air inflation systems have been specifically limited to being used either on or under a mattress. However, although additional comfort is realized when in the raised position, these systems are incapable of providing a system which is completely portable and enables its use in any desired location or in any desired surface, such as on the floor, couch or outdoors. Consequently, these prior art systems are extremely limited, and incapable of providing the full range of support and comfort the consumer is seeking.

The other prior art systems presently available, in an attempt to provide consumer's with complete comfort while in bed, are extremely expensive, motor-controlled, movable frame constructions having complex structures causing the mattress supporting frame to move or articulate in various directions upon command. Although these systems are capable of moving the mattress supported on the frame in a plurality of alternate positions and configurations, these prior art systems are limited in their ability, due to their inherent high cost as well as being usable only in a single location. Clearly, these prior art constructions are incapable of being moved to any desired location, as is desired.

Another inherent drawback with these expensive frame moving complex structures is their complete inability to attain a construction usable for a king-size or queen-size bed where both partners can independently and separately control the elevation of their back or leg supporting zones. Only by buying two separate systems are individuals able to approach independent control. However, such a requirement causes individuals to incur substantially added expense, while still not satisfying the consumer's needs and desires for an efficient, portable, self-contained, adjustable, construction which is reasonably priced.

Therefore, it is a principal object of the present invention to provide a multi-positionable, universally adjustable support system which is portable, self-contained, unitary in construction and enables multi-purpose use with both convenience and comfort.

Another object of the present invention is to provide a multi-positionable, universally adjustably support system having the characteristic features described above, which is inexpensive to manufacture while being substantially equivalent to expensive, complicated, mechanically operated bed raising systems.

Another object of the present invention is to provide the universally adjustable support system having the characteristic features described above which is sufficiently lightweight to be easily carried to any desired location for enabling the user to obtain the adjustable beneficial characteristics in any desired location or on any desired support surface.

A further object of the present invention is to provide the universally adjustable support system having the characteristic features described above which can also be permanently installed on a bed for use, when desired, while also being retained on the bed when not in use, without in any way interfering with the consumer's normal sleep habits.

Other and more specific objects will in part be obvious and will in part appear hereinafter.

SUMMARY OF THE INVENTION

In the present invention, the prior art drawbacks and difficulties are eliminated by providing a completely integrated, portable, position controlling system which comprises a unitary, adjustable, portable, self-contained, support assembly which incorporates two separate and independent adjustable sections integrally contained therein. In one section, typically used to support the back of the user, the support assembly is arcuately pivotable into virtually any desired position for supportingly maintaining the user in a particular elevated position. In another section, the support assembly is able to be elevated into a plurality of alternate configurations, in order to support the legs of the user in a raised position.

By providing a fully integrated unitary construction, a completely portable, universally adjustable support system is obtained which can be used in any desired location and on any desired surface. If desired, the support system of the present invention can be permanently installed on a bed to provide the user with the desired alternate positions when lying in bed, while also enabling the user to sleep with complete comfort on the system when in a fully horizontal position. As a result, a system is attained which does not have to be removed after use once installed on a bed, providing the benefits of prior art expensive equipment, while attaining all of these enhancements in a comparatively inexpensive construction.

One principal component incorporated into the fully integrated, adjustable support system of the present invention is the unitary, adjustable, portable, self-contained support assembly. This support assembly incorporates in a single, fully enclosed, unitary construction, a support pad, a bladder control frame assembly for raising and lowering the back supporting portion of the support pad, and an inflatable panel member for raising and lowering the leg supporting portion of the support pad. In addition, all of the components are fully enclosed within the unitary support assembly to assure complete portability of the support assembly and placement in any desired location for obtaining the comfortable positioning provided thereby.

In addition, the support assembly comprises shroud means peripherally surrounding and supportingly retaining and enclosing the bladder controlled frame assembly. In this way, the frame assembly is able to achieve its arcuate pivoting movement within the support assembly, without being outwardly visible. In addition, the shroud also incorporates elastic means formed thereon for maintaining the shroud in a compact configuration and assuring that any excess material is not visible. Furthermore, the elastic means also assures that the air inflated bladder of the bladder control frame system is easily returned from a fully expanded configuration to a fully contracted configuration, due to the elastic forces of the shroud assisting in forcing air out of the bladder, when so desired.

Another feature of the present invention is the attainment of a universally adjustable support system which is capable of being used by individuals having king or queen-size beds, with each individual being capable of complete independent control without affecting their partner. In the support system of this invention, individuals are able to select their own personally desired position for elevating either the back supporting portion or the foot supporting portion of the support assembly, while having virtually no effect on their partner. In prior art systems, no such dual independent control was possible without purchasing two separate, expensive systems.

In the present invention, separate, independent, movably adjustable, self-contained support assemblies are employed, with both support assemblies being movably adjustable by employing separate control means. In addition, both control means and both support assemblies are interconnected to a single air flow control assembly. As a result, a minimum of expensive components are employed and a dual, independent, fully adjustable position controlling system is attained for king size and queen-size beds.

The invention accordingly comprises the features of construction, combinations of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description taken in connection with the accompanying drawings in which:

FIG. 6 is a top plan view of the dual frame members incorporated into the support assembly of the present invention;

FIG. 7 is a side elevation view of the dual frame members of FIG. 6;

FIG. 8 is a top plan view of the bladder controlled frame assembly incorporated into the unitary, adjustable, portable, self-contained support assembly of the present invention;

FIG. 9 is a bottom plan view of the bladder controlled frame assembly of FIG. 8;

FIG. 10 is a side elevation view depicting the bladder controlled frame assembly of FIG. 8 in a fully inflated configuration;

FIG. 11 is a perspective view of the bladder controlled frame assembly of FIG. 10;

DETAILED DESCRIPTION

In FIGS. 1-5, integrated, portable, position controlling system 20 of the present invention is fully depicted. As shown therein, portable position controlling system 20 comprises unitary, self-contained, fully adjustable, portable support assembly 21, an air flow control assembly 22, and control means 23. Unitary adjustable support assembly 21 of position controlling system 20 is constructed for ease of portability and use in any desired location and on any desired support surface. In this way, the adjustable comfort provided by the present invention can be enjoyed anywhere desired.

Although the flexibility and portability of self-contained, unitary, adjustable support assembly 21 represents a principal unique aspect of position controlling system 20 of the present invention, its use and application on a conventional bed structure is one principal use for the present invention with which consumers are able to realize substantially enhanced bed elevating capabilities previously unobtainable. Consequently, this particular application is depicted throughout the drawings as the example for the use of this invention. However, this use of support assembly 21 represents a single application for support assembly 21 and is shown for exemplary purposes only, and is not intended, in any way, to limit the scope of the present invention.

Figure 1:
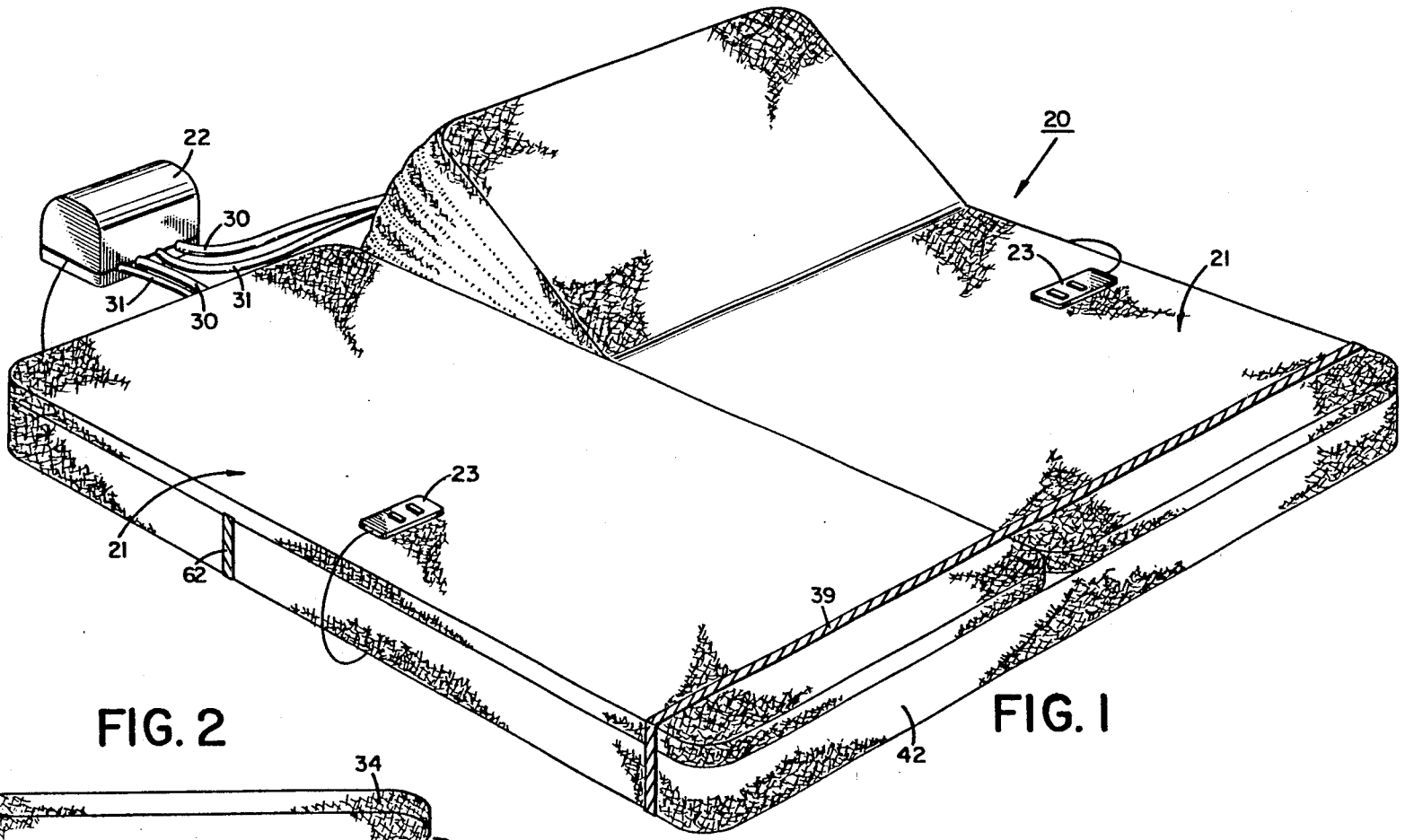
FIG. 1 is a perspective view of the integrated, portable, position controlling system of the present invention constructed for use on a king-size or queen-size bed to provide independent, movable, adjustability to both users thereof.

In FIG. 1, one of the principal features achieved in using the present invention on conventional beds is fully depicted. As shown therein, position controlling system 20 of the present invention provides complete, independent, self-controlled elevation to both the back-supporting portion and the leg-supporting portion of support assembly 21 to individuals having a king-size or queen-size bed without affecting their partner's side of the bed. In the prior art, no reasonably-priced system exists which allows individuals with king-size or queen-size beds to separately and independently control both a back supporting portion and a foot supporting portion of the bed while having no effect on their partner.

In the present invention, the independent control is achieved by employing two separate support assemblies 21, 21 with both support assemblies being independently interconnected to a single air flow control assembly 22. In this way, an integrated position controlling system 20 is achieved which reduces costs by eliminating duplication of equipment. In addition, the present invention enables individuals with king-size and queen-size beds to individually enjoy the benefits of comfortable position adjustability of both the back-supporting portion and the leg-supporting portion of support assembly 21, while having absolutely no effect or movement over their partner's separate and independent support assembly 21.

Each unitary, fully adjustable support assembly 21 is operated by channeling air flow into bladder members mounted within support assembly 21. In the preferred embodiment, one of the bladder members is constructed to enable the back-supporting portion of support assembly 21 to be pivotally adjusted into any desired position within an arc of about 80°. As a result, the user is able to movably position support assembly 21 into any desired position from completely horizontal to almost vertical. The second bladder member is constructed to enable the leg-supporting portion of support assembly 21 to be elevated and retained in a plurality of alternate positions ranging from completely horizontal to a raised level of about 10 inches above horizontal.

In order to assure complete, independent movement of each support assembly 21 upon demand, separate sets of air delivery hoses 30 and 31 are provided. Each pair of air delivery hoses 30 and 31 are separately connected to each of the two support assemblies 21, 21, thereby attaining the desired result, with a minimum of expensive components.

Finally, two separate control means 23, 23 are independently interconnected to air flow control assembly 22. As is fully detailed below, each control means 23 is constructed to enable the user to activate air flow control assembly 22 to enable either the back supporting portion or the leg-supporting portion of one support assembly 21 to be raised or lowered as desired. In this way, an individual using one of the support assemblies 21 is capable of activating air flow control assembly 22, to cause that support assembly 21 to be movably adjusted into any desired elevated position.

As is evident from FIG. 1, even when one support assembly 21 is activated and moved in a desired elevated position by one individual, that position is achieved completely independently of the second support assembly 21 and without having any effect on the adjacent support assembly 21. In this way, a fully integrated, position controlling system 20 is achieved which provides complete, independent, dual control thereof.

By referring to FIGS. 2, 3, 4, and 5, the construction details for attaining the unitary, adjustable, portable, self-contained support assembly 21 of this invention can best be understood. In the preferred embodiment, support assembly 21 comprises an elongated support pad or cushion 33 which defines the overall size and shape of support assembly 21. In addition, support assembly 21 also comprises a covering or layer of material 34 which overlies elongated support pad 33 and peripherally surrounds and envelopes elongated support pad 33. In addition, cover 34 shields support pad 33 from being seen, as well as shielding all of the remaining components mounted in association with pad 33 from being seen.

One component mounted in association with elongated support pad 33 is bladder controlled frame assembly 35, which is mounted at one end of support pad 33 in direct, overlying, covering contact with one surface thereof. At the opposed end of elongated support pad 33, inflatable panel member 36 is mounted with one surface thereof being in overlying, covering, contacting engagement with one surface of support pad 33.

The final component employed to complete the construction of support assembly 21 is shroud 37, which is mounted to cover 34 in a manner which peripherally surrounds and envelopes bladder control frame system 35. As is more fully detailed below, shroud 37 comprises elastic biasing means formed therewith, which normally maintains shroud 37 in a fully retracted position, while also enabling shroud 37 to expand in response to the movement of bladder controlled frame system 35.

Figure 5:
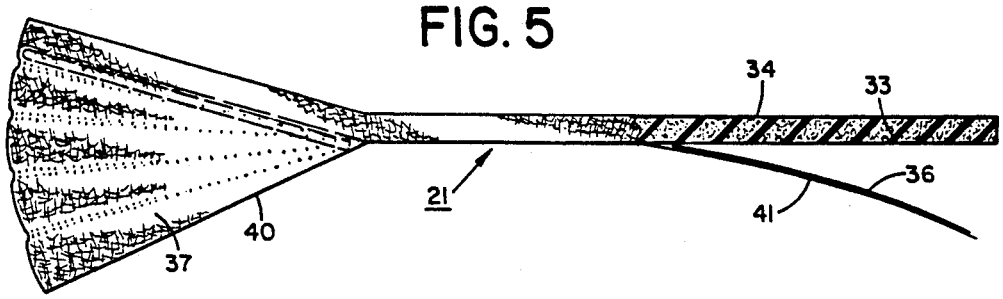
FIG. 5 is a side elevation view, partially in cross-section, depicting the construction of the unitary, adjustable, self-contained support assembly of the present invention.

As best seen in FIG. 5, the unitary, adjustable, portable, self-contained support assembly 21 of the present invention is preferably constructed by peripherally surrounding cover 34 about elongated support pad 33, with cover 34 peripherally surrounding and overlying substantially all surfaces of elongated support pad 33, except for the bottom surface at both ends of support pad 33. In these two uncovered areas, the free portion of cover 34 forms flaps 40 and 41.

In the construction of support assembly 21, inflatable panel member 36 is placed in overlying contacting engagement with flap 41 and, in the preferred embodiment, physically attached to flap 41 along the side edges of panel member 36. Then, flap 41 is affixed to the open ends of cover 34. In this way, inflatable panel member 36 is securely sealed within support assembly 21 in intimate, secured, controllable contacting engagement with one surface of elongated support pad 33.

The assembly of the opposed end of support assembly 21 is completed by inserting bladder control frame assembly 35 in direct, overlying, contacting, supporting, engagement with the exposed surface of pad 33. Then, bladder control frame assembly 35 is sealingly enclosed with elongated support pad 33 by mounting shroud 37 between the remaining open edges of cover 34 and flap 40. Once this assembly is completed, support assembly 21 of this present invention is attained and the unitary, fully adjustable, portable, self-contained support assembly of this invention is provided.

Figure 3:
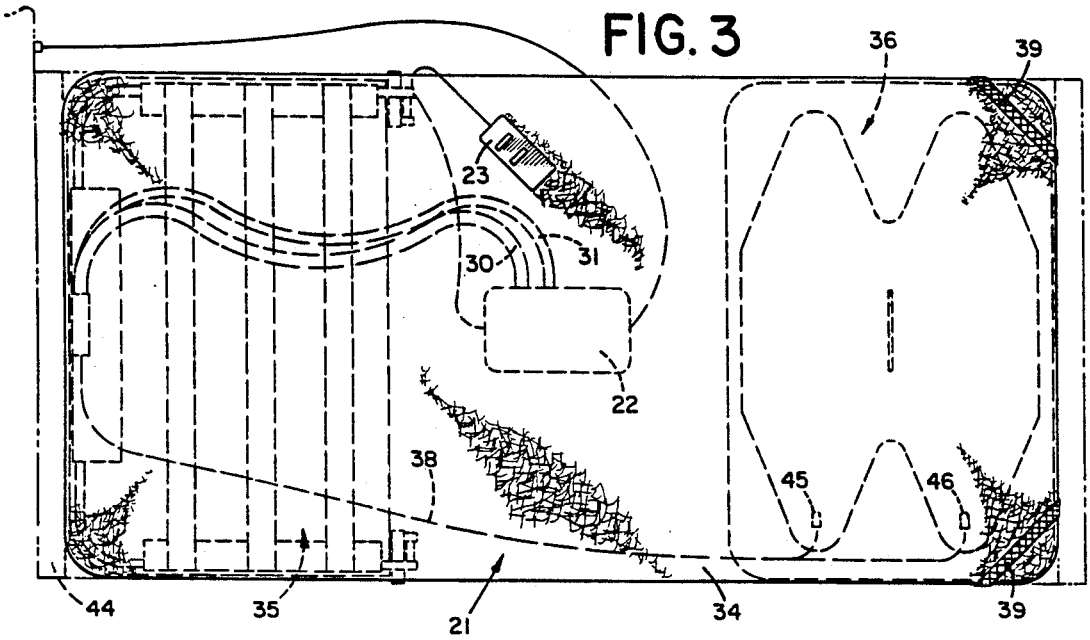
FIG. 3 is a top plan view of the unitary, adjustable, self-contained support assembly of the position controlling system of the present invention positioned on a conventional twin-size bed.
Figure 4:
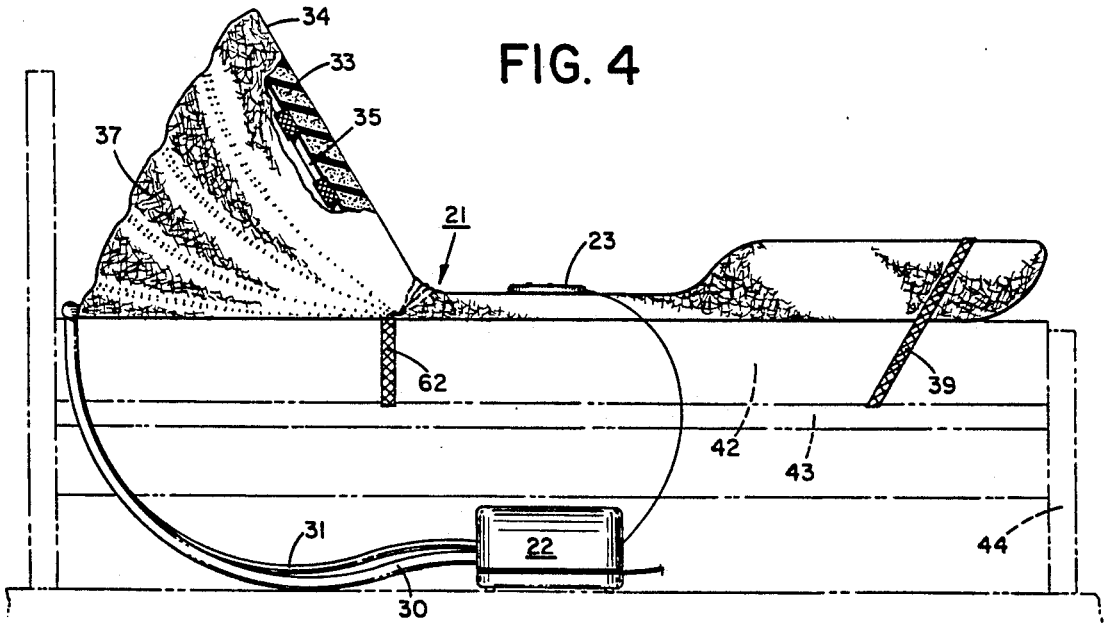
FIG. 4 is a side elevation view, partially in cross-section, of the unitary, self-contained support assembly of FIG. 3.

By employing the construction detailed above, the resulting position controlling system 20 is capable of being easily carried for placement on any desired surface, in order to enable the comfort enhancing qualities provided by position controlling system 20 to be enjoyed anywhere. For purposes of illustration, FIGS. 3 and 4 depict position controlling system 20 mounted on a conventional twin-size bed for enjoyment by a single individual, with the bed shown in phantom as comprising a mattress 42, a box spring 43, and a frame 44.

In using position control system 20 of the present invention, an individual lies down on cover 34, with elongated support pad 33 providing the supporting cushioning for the individual. Of course, when support assembly 21 is positioned on a conventional bed, as shown in FIGS. 4 and 5, further supporting comfort is provided by mattress 42 and box spring 43.

With unitary, adjustable support assembly 21 placed in overlying covering engagement with the top surface of mattress 42, the user merely lies down on covering layer 34 and elongated support pad 33, and grasps control means 23 in order to activate position controlling system 20. If elevation of the back of the user is desired, the appropriate button on control means 23 is pressed, causing air flow control assembly 22 to be activated into forcing air to flow through hose 30. This air flow then causes bladder control frame assembly 35 to be inflated. As bladder control frame assembly 35 is inflated, the entire back supporting portion of pad 33 of support assembly 21 is raised into any desired position, between 0° and 80°.

At any time the desired elevated position is reached, the user merely removes activation pressure from control means 23, causing the air flow to stop. In this way, the user is able to quickly and easily position the back supporting position of pad 33 of support assembly 21 in any desired angular relationship relative to the flat horizontal surface of mattress 42. One such arcuately raised position for support pad 33 of support assembly 21 is shown in FIG. 4.

Whenever the user wishes to return to the horizontal position, the user merely presses the appropriate button on control means 23, which causes bladder control frame assembly 35 to automatically become deflated. In the preferred embodiment of the present invention, as is further detailed below, the air is removed from bladder control frame assembly 35 automatically, without requiring the motor to be activated. It has been found that weight of the user coupled with the elastic forces inherent in the construction of shroud 37 enables bladder control frame assembly 35 to be quickly and efficiently moved from a fully raised position to its horizontal position.

Figure 2:
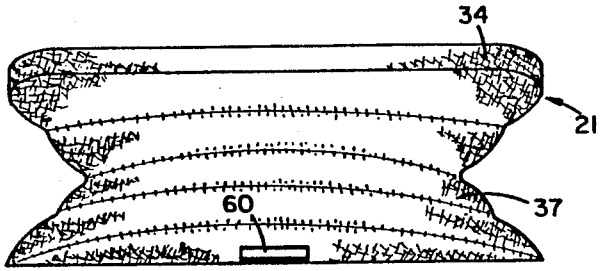
FIG. 2 is a rear elevation view of the unitary, portable, self-contained support assembly of the position controlling system depicted in a partially elevated position.

In addition to assisting and forcing the air out of bladder control frame assembly 35, the elastic biasing means formed in shroud 37 also assure that shroud 37 automatically contracts from its fully extended position, depicted in FIG. 4, to a fully contracted position, wherein shroud 37 is virtually unseen due to its contraction into a compact, integrated, cooperating interengagement with bladder control frame assembly 35. This position is depicted in FIG. 3. In FIG. 2, shroud 37 is depicted partially expanded contracted due to the elastic biasing means formed therein. This position would be realized during the raising or lowering of support assembly 21.

When the lower, leg supporting portion of support assembly 21 is to be elevated, the user presses the appropriate buttons on control means 23 to activate the inflation of panel member 36. As shown in FIGS. 3 and 4, air flow delivery hose 31 extends from air flow control assembly 22 in association with hose 30. Hose 30 is mounted in interengagement with bladder control frame assembly 35, while hose 31 is connected to interior tubing 38, the terminating end of which is positioned with the inlet to bladder control frame assembly 35. Tube means 38 is mounted within cover 34, extending along a surface of support pad 33 to interconnected engagement with inlets 45 and 46 of inflatable panel member 36.

As a result, once an individual activates controller 23 for raising the leg supporting portion of support assembly 21, air flow control assembly 22 is activated, causing air to flow through tube 31 and tube 38 to panel member 36. Upon receipt of this air flow, panel member 36 is inflated, causing pad 33 to be moved away from flap 41. This movement causes the legs of the user to be raised by the supporting surface of pad 33, as depicted in FIG. 4.

In the preferred embodiment, as depicted in FIGS. 3 and 4, strap means 39 are mounted at the opposed corners in association with panel member 36. In the preferred embodiment, a continuous, elastic strap is employed which is wrapped about mattress 42 in order to secure the ends of pad 33 to mattress 42. Of course, if desired, separate fastenable straps can be employed, as opposed to using a continuous strap.

Strap means 39 are preferably employed in order to assure that the ends of pad 33 are prevented from being excessively lifted away from mattress 42 during the inflation of panel member 36. It has been found that by incorporating straps 39 along at least the corners of pad 33, this unwanted lifting is eliminated and a more comfortable, aesthetically pleasing result is achieved.

In order to best understand the overall operation of integrated, portable, position controlling system 20 of the present invention, the details of construction of both bladder control frame assembly 35 and inflatable panel member 36 should be understood. By referring to FIGS. 6–11, along with the following detailed disclosure, the details of construction, and operation of bladder control frame assembly 35 can best be understood.

The principal components of bladder control frame assembly 35 are outer, U-shaped frame member 50, inner U-shaped frame member 51, and bladder 52. In the preferred embodiment, U-shaped frame members 50 and 51 are interconnected to each other at both of their opposed terminating ends by bolt means 53. Preferably, bolt means 53 enable outer U-shaped frame member 50 to be freely pivotable relative to inner frame member 51 about the axis defined by bolt means 53.

In the preferred embodiment, frame members 50 and 51 are constructed and interconnected to possess a nested, interleaved configuration, wherein both frame members 50 and 51 lie in the same plane. This position and configuration is shown in FIGS. 6 and 7.

In addition, a spacer 54 is preferably mounted coaxially with each of the bolt means 53 to maintain U-shaped frame members 50 and 51 at a fixed spaced distance relative to each other. This spaced distance is preferably maintained to be greater than the normal width of an individual's finger or thumb. By assuring this spacing between frame members 50 and 51, accidental pinching or unwanted capture of any individual's fingers should be avoided.

In FIGS. 8–11, the interconnected, mounted, controlled engagement of bladder 52 with frames members 50 and 51 can best be seen. In the preferred construction, bladder 52 comprises an enlarged sealed interior chamber having frame engaging outer surfaces 57 and 58. In order to securely retain and controllably move U-shaped frame members 50 and 51 in the desired arcuate path, frame retaining sleeves 59 are affixed to outer surfaces 57 and 58 of bladder 52. Preferably, three independent frame retaining sleeves 59 are mounted on each frame engaging surface 57 and 58 in order to securely retain each of the separate legs of U-shaped frame members 50 and 51. In this way, smooth, twist-free arcuate movement of frame members 50 and 51 is provided.

The construction of bladder 52 is completed by securely affixing air-delivery conduit 60 to frame engaging surface 57 of bladder 52. In the preferred construction, conduit 60 is sealingly connected at one end thereof to the internal sealed zone of bladder 52, with its opposed end being constructed for ready interconnected engagement with air delivery tube 30. In this way, once the air flows through tube 30, the air is channeled directly into the sealed interior of bladder 52, thereby causing bladder 52 to inflate.

As shown in FIGS. 10 and 11, during the inflation process, bladder 52 will expand causing outer frame member 50 to arcuately pivot relative to inner frame member 51. This arcuate pivoting motion of frame member 50 is caused since inner frame member 51 is positioned directly on the supporting surface such as mattress 42 as shown in FIG. 10. In the preferred embodiment, bladder 52 is constructed to enable outer frame member 50 to pivot through an arc up to a maximum of about 80°. However, as fully discussed above, the inflation of bladder 52 can be halted at any time by the user in order to retain frame member 50 elevated at any position ranging between 0° and 80°. In FIGS. 10 and 11, the fully inflated raised position of outer frame member 50 is shown.

When unitary, adjustable, self-contained support assembly 21 of this invention, with bladder control frame system 35 mounted therein, is used in permanent, overlying covering engagement with mattress 42, it is preferred that strap means 62 are employed. In the preferred construction, elongated strap means 62 are securely affixed to both terminating ends of inner frame member 51 and extend therefrom, with conventional fastening means mounted at the opposed ends of strap means 62, in order to enable the strap means to be securely interconnected with each other. In this way, strap means 62 can be wrapped about mattress 42 to securely hold bladder controlled frame system 35, as well as unitary support assembly 21 within which bladder control frame assembly 35 is affixed, to mattress 42. As a result, the entire unitary support assembly 21 is prevented from sliding on the surface of mattress 42, thereby assuring continuous, long-term, trouble-free mounted interengagement of support assembly 21 with mattress 42.

The construction of bladder controlled frame system 35 is completed by securely affixing a plurality of support straps 65 between opposed, facing legs of U-shaped frame member 50. As clearly shown in FIGS. 8, 10 and 11, the opposed terminating ends of each elongated strap 65 is securely affixed to the opposed facing legs of U-shaped frame member 50, with straps 65 extending in substantially parallel relationship across frame engaging surface 58 of bladder 52. Although straps 65 can be positioned in a plurality of alternate locations, it is preferred that strap receiving zones be cut out from frame retaining sleeves 59 in order to enable straps 65 to be mounted in parallel relationship with each other along the length of frame retaining sleeves 59 of bladder 52.

By securely mounting a plurality of elongated support straps 65 in the manner detailed above, with each of the elongated straps 65 being securely affixed at their opposed ends to maintain each of the straps 65 relatively stiff or taut, any unwanted twisting or skewed movement of frame member 50 relative to frame member 51 during the inflation process or use is avoided. In addition, elongated straps 65 provides a secure, firm substantially movement-free support surface for pad 33 and the user's weight thereon. Furthermore, it has been found that elongated support straps 65 also assure that bladder 52 is inflated in a more efficient manner, and any unwanted ballooning of bladder 52 within U-shaped frame member 50 is prevented by the resistance provided by straps 65.

Figure 24:
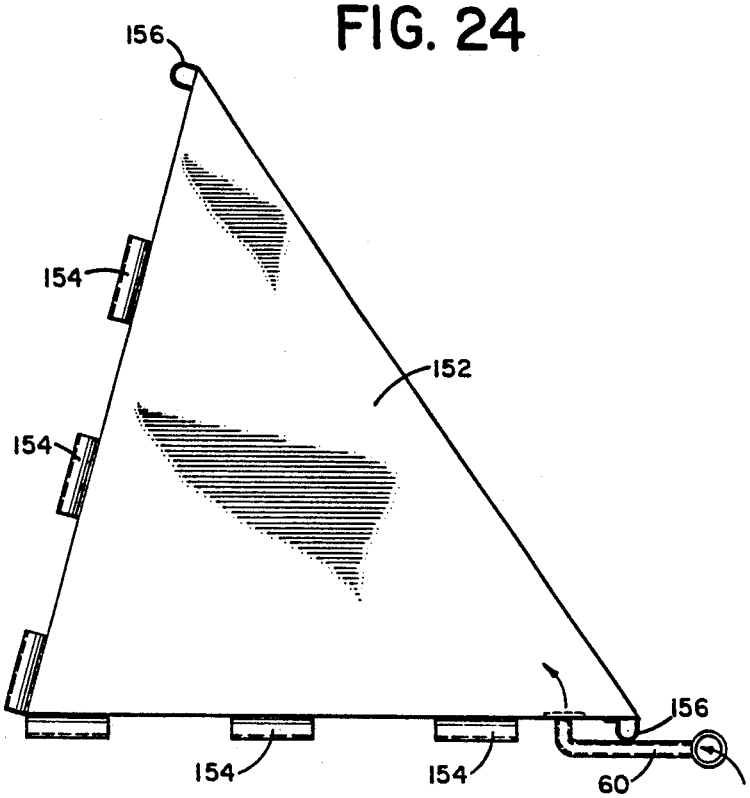
FIG. 24 is a side elevation view of an alternate embodiment of the bladder assembly of the present invention, with the bladder depicted fully inflated.
Figure 25:
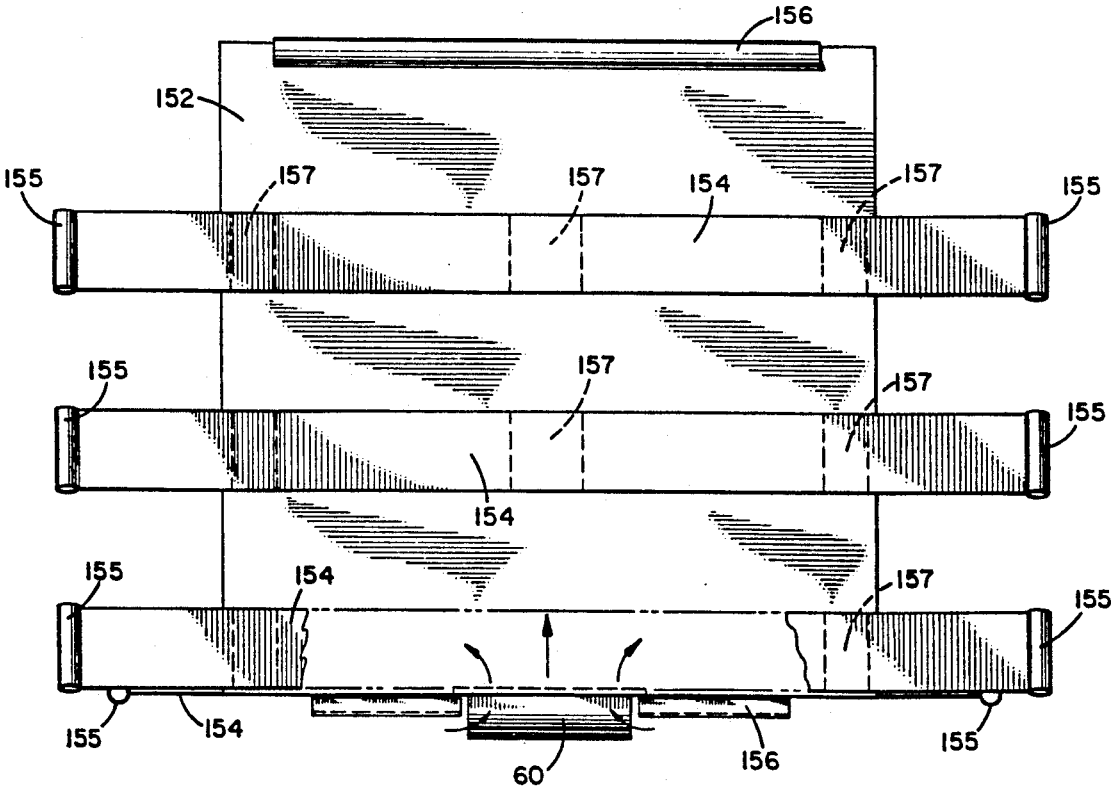
FIG. 25 is a rear view of the bladder assembly of FIG. 24.

In FIGS. 24, and 25, an alternate construction for the inflatable bladder of the present invention is depicted. In this embodiment, bladder 152 comprises an overall size and shape which defines the sealed chamber to be inflated for controlling the movement of U-shaped frame members 50 and 51.

As detailed above in reference to bladder 52, bladder 152 incorporates an air delivery conduit 60 sealingly affixed to one surface of bladder 152. Conduit 60 preferably is sealingly connected at one end thereof to the internal sealed zone of bladder 152 with the opposed end of conduit 60 being positioned for easy interconnected engagement with air delivery tube 30. In this way, once the air flows through tube 30, the air is channeled directly into the sealed interior of bladder 152, causing bladder 152 to inflate.

In order to securely mount bladder 152 to frame members 50 and 51, a plurality of elongated straps 154 are mounted along two adjacent surfaces of bladder 152. In the preferred embodiment, straps 154 are mounted in substantially aligned parallel relationship on the desired surface of bladder 152, with each strap being securely affixed to the bladder surface at a plurality of points along its length thereof, or along its entire length.

In the preferred embodiment, each strap 154 is heat sealed in at least three spaced locations 157 along its length directly to bladder 152. In this way, an integral, mounted engagement of straps 154 to bladder 152 is attained. If desired, any alternate fastening method may be employed to securely mount straps 154 to bladder 152, without departing from the scope of this invention.

As shown in FIG. 25, each elongated strap 154 comprises frame leg holder 155 formed at each terminating end in a substantially open, hollow, cylindrically shaped configuration. In this way, the legs of frame members 50 and 51 are easily inserted and securely retained by holders 155.

In addition, in order to assure the secure mounted interengagement of bladder 152 with frame members 50 and 51, additional frame engaging sleeves 156 are mounted along the terminating edge of the surface of bladder 152 to which straps 154 are securely mounted. In this way, bladder 152 is capable of being securely mounted to both the side legs and intermediate portion of each frame member 50 and 51 in secure, movement controlling engagement to assure the desired arcuate controlled movement thereof.

Figure 12:
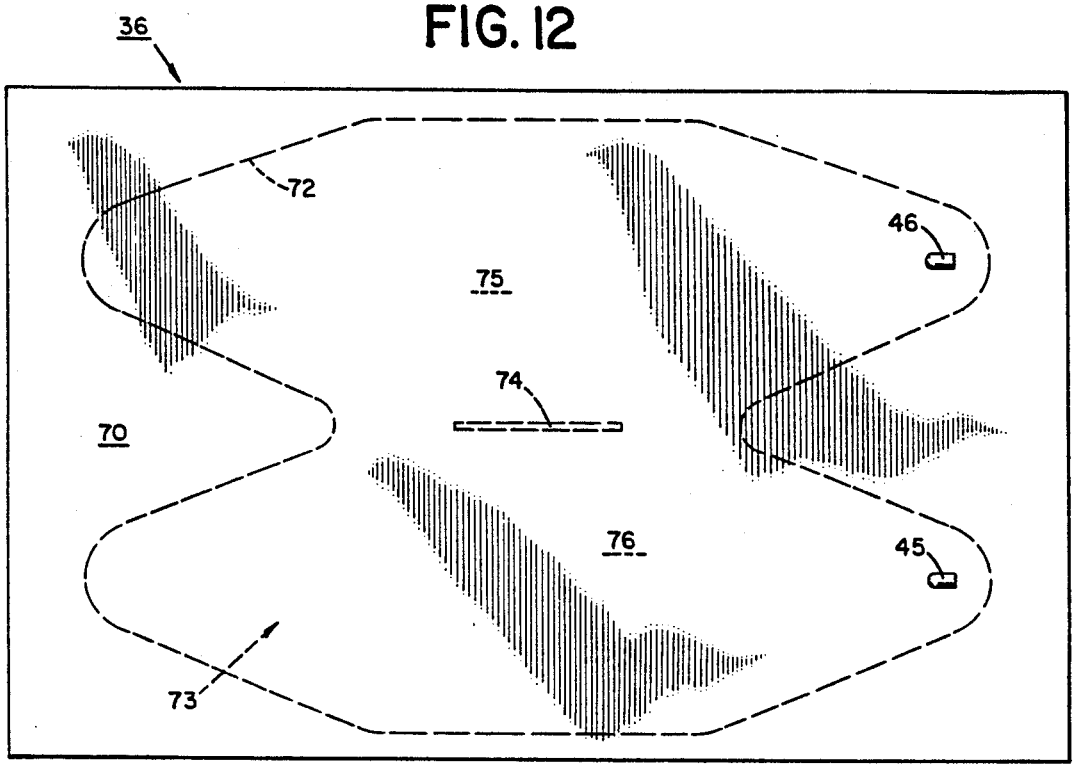
FIG. 12 is a top plan view of the inflatable panel member incorporated into the unitary, adjustable, portable, self-contained support assembly of the present invention.
Figure 13:
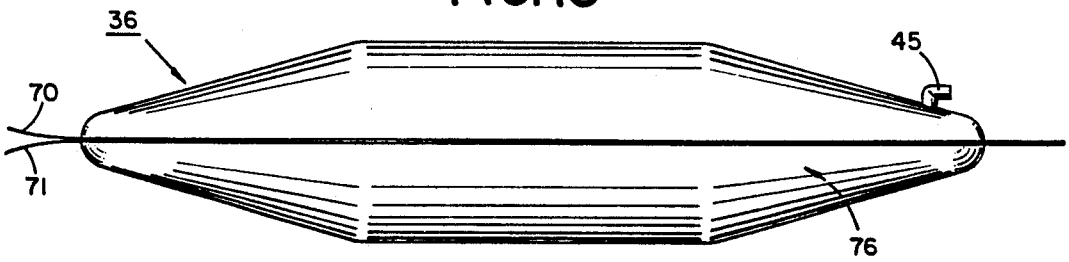
FIG. 13 is a front elevation view of the inflatable panel member of FIG. 12 depicted in a fully inflated configuration.
Figure 14:
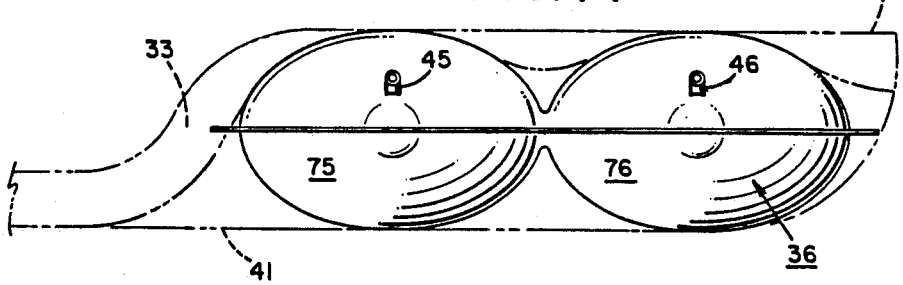
FIG. 14 is a side elevation view of the fully inflated panel member depicted in FIG. 13.

By referring to FIGS. 12, 13 and 14, along with the following detailed disclosure, the construction and operation of inflatable panel member 36 can best be understood. In the preferred embodiment, panel member 36 comprises two substantially identically shaped layers 70 and 71 of air impervious material which are placed in overlying, contacting engagement with each other. In addition, layers 70 and 71 are heat sealed to each other, along sealing line 72, in order to form an internal air impervious zone 73 between layers 70 and 71. In addition, inlets 45 and 46 are mounted to layer 70 within heat seal line 72, thereby providing an air inlet for inflating the air retaining interior zone 73 formed between layers 70 and 71.

In the preferred embodiment, the interior air retaining zone 73 is formed as two substantially equal sized, generally oval shaped chambers which are interconnected along one surface thereof. In the preferred embodiment, an interior partition 74 is placed between layers 70 and 71 and sealed therebetween, in order to define interior generally oval chambers 75 and 76 and assure the controlled inflation thereof.

In the preferred embodiment, as clearly depicted in FIG. 12, each of the chambers 75 and 76 is formed with each opposed end thereof having a shape, when uninflated, that substantially defines an equilateral triangle with the apex thereof comprising a smoothly rounded and blended curve, which converges with the sides thereof. As shown in FIG. 13, when inflated, each chamber 75 and 76 comprises a shape at each of its ends which forms a cone connected at its base to a centrally disposed cylindrical shape, with the cone terminating with a smoothly rounded apex.

This particular shape has been found to be particularly important in assuring the filling of chambers 75 and 76 in a manner which assures maximum inflation in the central portion of chambers 75 and 76 in order to attain the desired result. By employing this construction, inflatable panel member 36 achieves the fully inflated configuration depicted in FIG. 13, with the principal inflation zone being centrally disposed along inflatable panel member 36, with the sides thereof providing a smooth, narrowing tapered configuration.

In FIG. 14, inflatable panel member 36 is depicted fully inflated with support pad 33 and cover layer 34 shown in phantom. As is evident from FIG. 14, the full inflation of panel member 36 causes chambers 75 and 76 to become fully enlarged which simultaneously causes support pad 33 to be moved out of engagement with flap 41 of cover 34. As a result, cover 34 and pad 33 are moved upwardly, away from flap 41 which is in contact with the surface on which support member 21 has been placed.

Typically, the legs of the user are resting on pad 33 and cover 34 in the area overlying panel member 36. As a result, the inflation of panel member 36 causes the legs of the user to be raised, enhancing the comfort of the user by lifting the legs to any desired position between completely horizontal and the fully inflated position depicted in FIG. 14.

In FIGS. 15–23, the construction of air flow control assembly 22 of the present invention is fully detailed. Throughout these drawings and the detailed disclosure associated therewith, air flow control assembly 22 is depicted in the preferred construction employed for providing the desired air delivery to one, unitary, adjustable, portable, self-contained support assembly 21. However, as previously discussed in relation to FIG. 1, two unitary support assemblies 21, 21, may be employed as part of the present invention. Consequently, the following detailed disclosure and accompanying drawings detail the construction variations required for enabling two support assemblies to be independently operated with a minimum of components.

Figure 15:
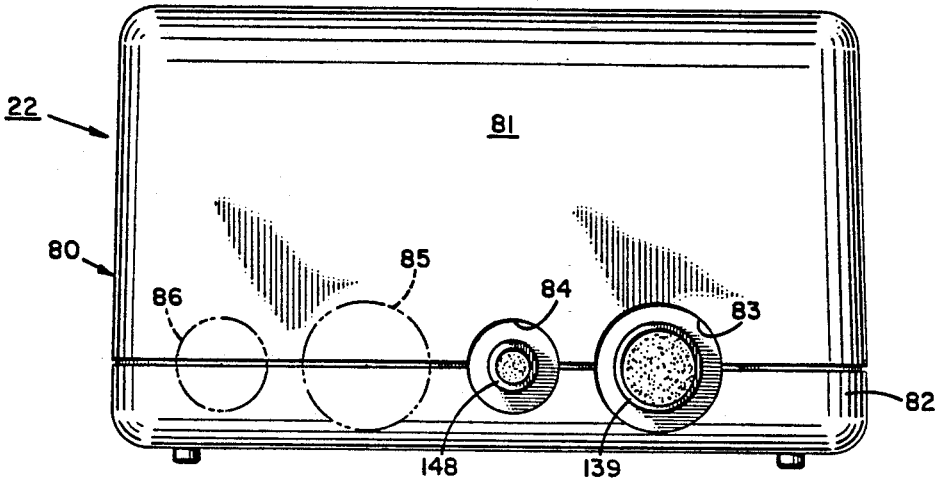
FIG. 15 is a side elevation view of the air flow control assembly which forms a part of the integrated, portable, position controlling system of the present invention.
Figure 16:
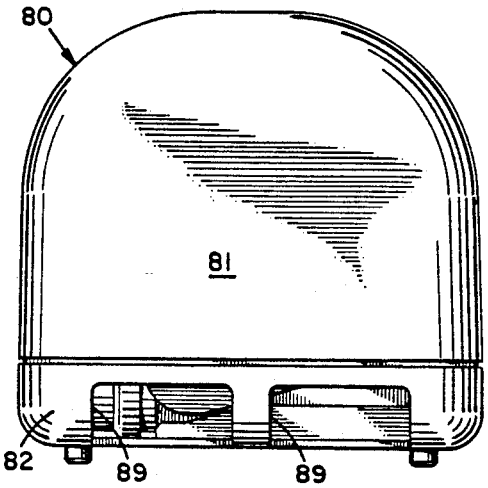
FIG. 16 is a front elevation view of the air flow control assembly of FIG. 15.

As shown in FIGS. 15 and 16, air flow control assembly 22 comprises an outer housing 80 formed by upper portion 81 and lower portion 82, which portions are matingly interconnected with each other. As shown in FIG. 15, housing 80 incorporates two portals 83 and 84 through which hoses 30 and 31 are mounted in order to obtain the desired air flow for inflating support assembly 21. In addition, as depicted in FIG. 15, when air flow control assembly 22 is constructed for use with two adjacent, unitary support assemblies 21, 21 as depicted in FIG. 1, portals 85 and 86 are also be formed in housing 80.

Figure 18:
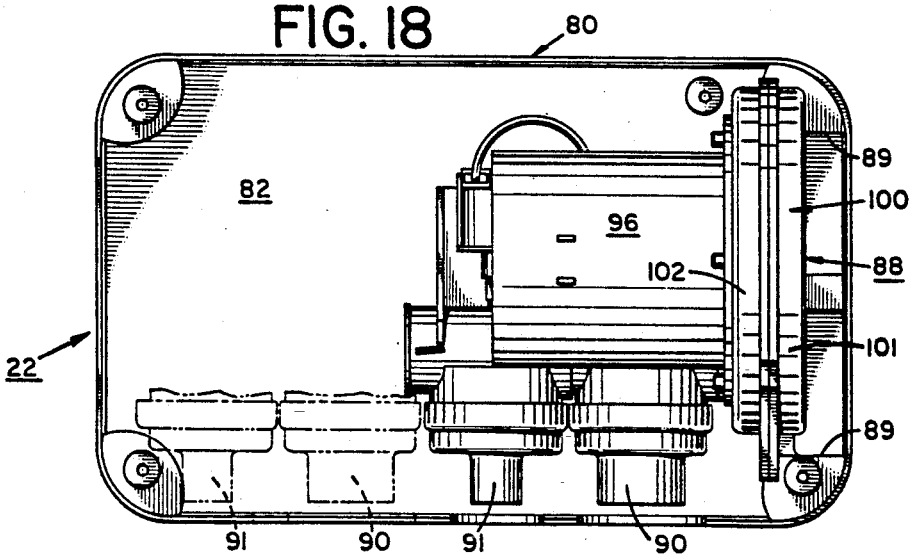
FIG. 18 is a top plan view of the air flow control assembly of FIG. 17.

In order to provide the desired air flow for inflating both bladder controlled frame assembly 35 and panel member 36 of unitary, self-contained support assembly 21, housing 80 of air flow control assembly 22 incorporates a motor assembly 88 and flow controlling valve assemblies 90 and 91. As depicted in FIG. 18, when air flow control assembly 22 is constructed for delivering the air flow to two independent, adjacent, unitary support assemblies 21, 21, as depicted in FIG. 1, a second set of air controlled valve assemblies 90, 91 are mounted in housing 80, as depicted in FIG. 18 in phantom.

In order to assure complete, trouble-free accessibility of air to motor assembly 88 when required, lower portion 82 of housing 80 incorporates substantially enlarged cut out zones 89 formed therein. By incorporating two enlarged cut out zones 89 in lower portion of housing 80, ambient air is easily drawn into housing 80 for delivery to motor assembly 88 with complete ease and without incurring any noise or possibility of blockage.

By referring to FIGS. 17 through 20, along with the following detailed disclosure, the construction and operation of motor assembly 88 can best be understood. As shown therein, motor assembly 88 comprises a conventional electrical motor 95 which is retained within motor housing 96. In the preferred construction, motor housing 96 peripherally surrounds and completely envelopes motor 95 in order to assist in reducing the noise typically associated with motor 95 when activated.

In the typical construction, motor 95 comprises a rotationally driven shaft 97 to which pump fan blade assembly 98 is securely affixed for being rotationally driven thereby. In order to assure the proper position of rotationally driven fan blade assembly 98, bushing 99 is mounted on shaft 97 between pump fan blade assembly 98 and motor 95.

Figure 17:
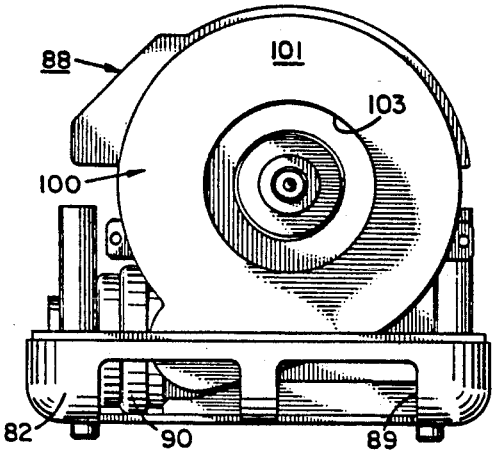
FIG. 17 is a front elevation view of the air flow control assembly of FIG. 15 with the upper portion of the housing removed.

In order to control and properly channel the air flow achieved by the rotation of pump fan blade assembly 98, fan blade assembly 98 is peripherally surrounded and sealingly contained within fan blade housing 100 which is formed by inlet bearing portion 101 and outlet bearing portion 102. As depicted in FIG. 17, inlet bearing portion 101 of housing 100 incorporates a substantially enlarged air inlet portal 103 through which the external air can flow from the outside atmosphere directly into housing 100 for being driven in the desired direction by rotating fan blade assembly 98.

Figure 19:
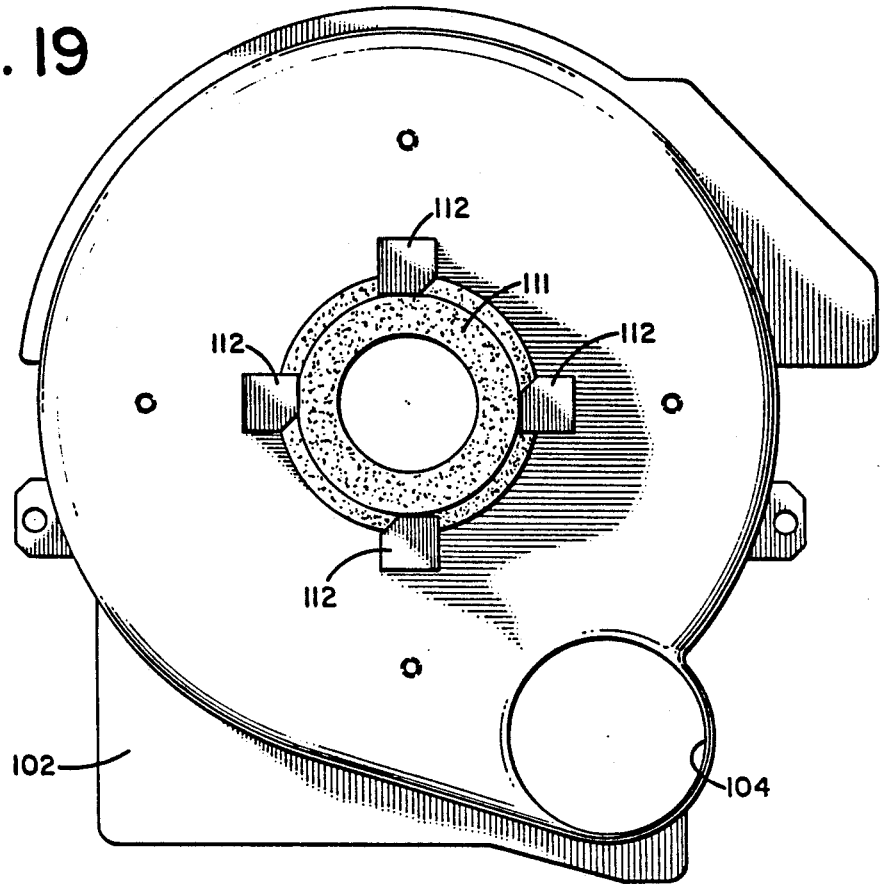
FIG. 19 is a rear elevation view of the fan blade assembly housing forming a part of the air flow control assembly of the present invention.

As shown in FIG. 19, outlet bearing portion 102 of fan housing 100 comprises an outlet portal 104 through which the air flow generated by motor 95 and pump fan blade assembly 98 is channeled. In this way, whenever motor assembly 98 is activated, the air from outside housing 80 is drawn into pump fan blade assembly 98 and delivered to outlet 104 for subsequent delivery to support assembly 21, as detailed below.

As previously discussed, one of the principal objections found in most prior art constructions is the noise caused by the motor when the motor is running. This problem is not only found in position controlling system of the nature herein described, but has been generally found in any electrically driven motor. This problem is typically caused by the inherent vibration caused by the motor during its operation and the transmittal of these vibrations to the housing in which the motor is contained. However, in the present invention, this continuing, previously unsolved complaint has been virtually eliminated.

Figure 20:
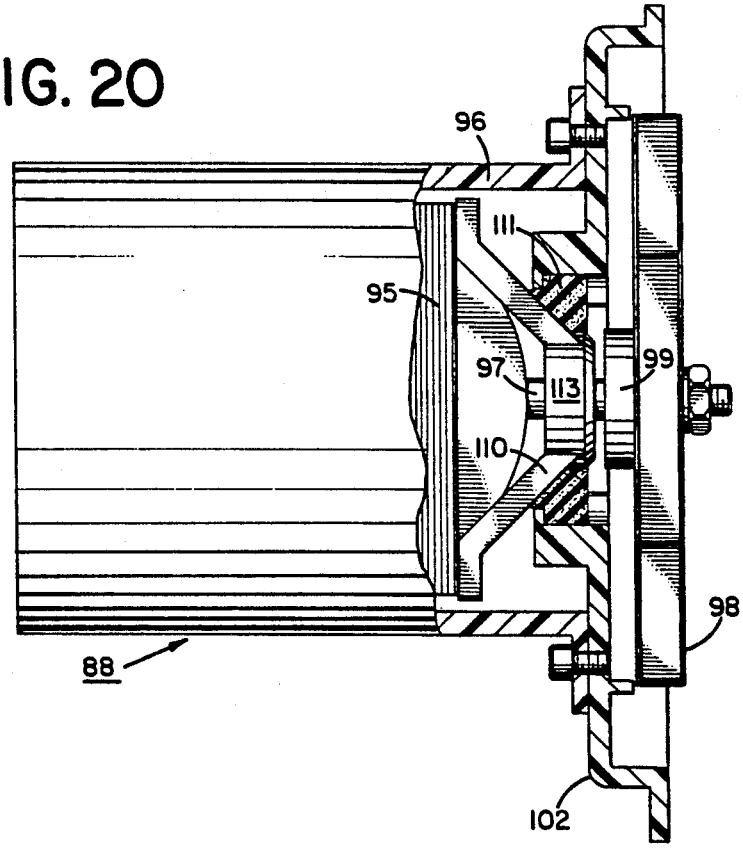
FIG. 20 is a top plan view, partially in cross-section and partially broken away, of the motor assembly incorporated into the air flow control assembly of the present invention.

By referring to FIGS. 19 and 20, the unique suspended construction of motor 95 to achieve a virtually vibration free environment is clearly shown. As depicted therein, motor 95 is supported by frame 110 through which rotating shaft 97 passes. In most typical prior art constructions, motor 95 is securely held by attaching motor 95 to a support position within its housing or by affixing frame 110 to the housing. However, by employing this prior art construction, it has been found that the vibration caused by motor 95 is transferred to the supporting housing, causing the objectionable vibration induced hum or noise which has plagued the industry.

In the present invention, this prior art problem is completely eliminated by suspending motor 95 and frame 110 in foam block 111 which is affixed to outlet bearing portion 102 of fan housing 100, while also peripherally surrounding and supportingly holding frame 110 and motor 95. In the preferred construction, foam block 111 comprises a substantially toroidal shape and is securely mounted to the outside surface of outlet bearing portion 102 of fan housing 100 by employing a plurality of upstanding, peripherally surrounding retaining clips 112. Preferably, retaining clips 112 are either formed as an integral part of outlet bearing portion 102 of fan housing 100 or are individually securely bonded directly to the outside surface of outlet bearing portion 102.

When placed in the precisely desired position, retaining clips 102 peripherally surround and securely embrace foam blocks 111 which incorporate a centrally disposed open zone 114 which is constructed for peripherally surrounding and securely embracing annular portion 113 of frame 110. By employing this construction, motor 95 with frame 110 is securely mounted and retained within peripherally surrounding housing 96 for secure, trouble-free operation, while foam block 111 provides motor 95 with a vibration absorbing, peripherally surrounding and supporting environment which prevents any vibration of motor 95 to be transmitted to housing 96 or housing 100. As a result, the objectionable hum or noise typically associated with an operating motor is virtually eliminated.

Figure 27:
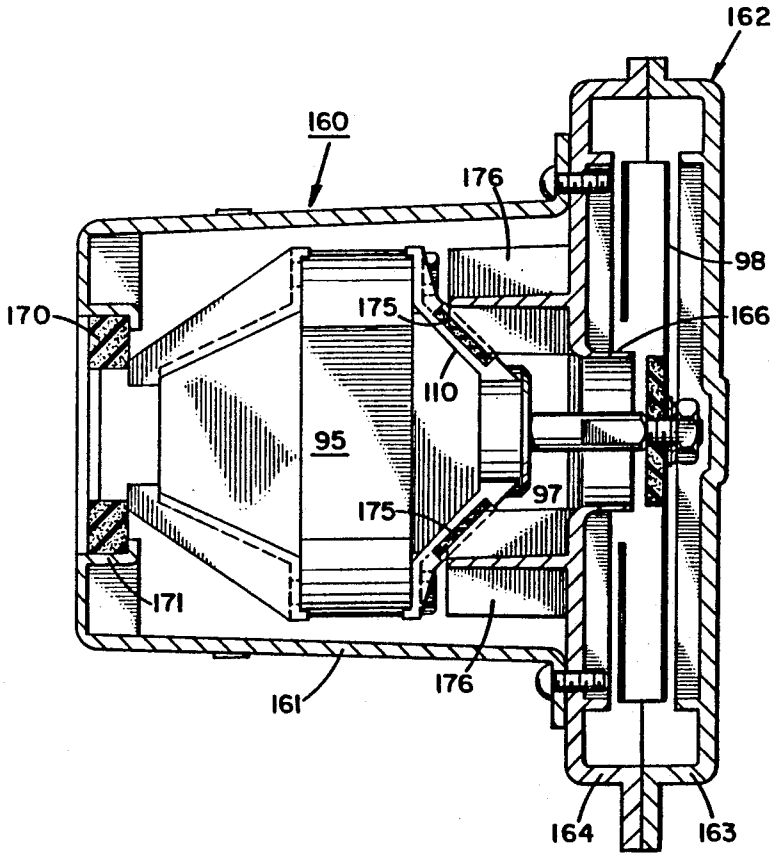
FIG. 27 is a cross-sectional, side elevation view of the motor assembly of FIG. 26, taken along line 27—27 of FIG. 26.
Figure 26:
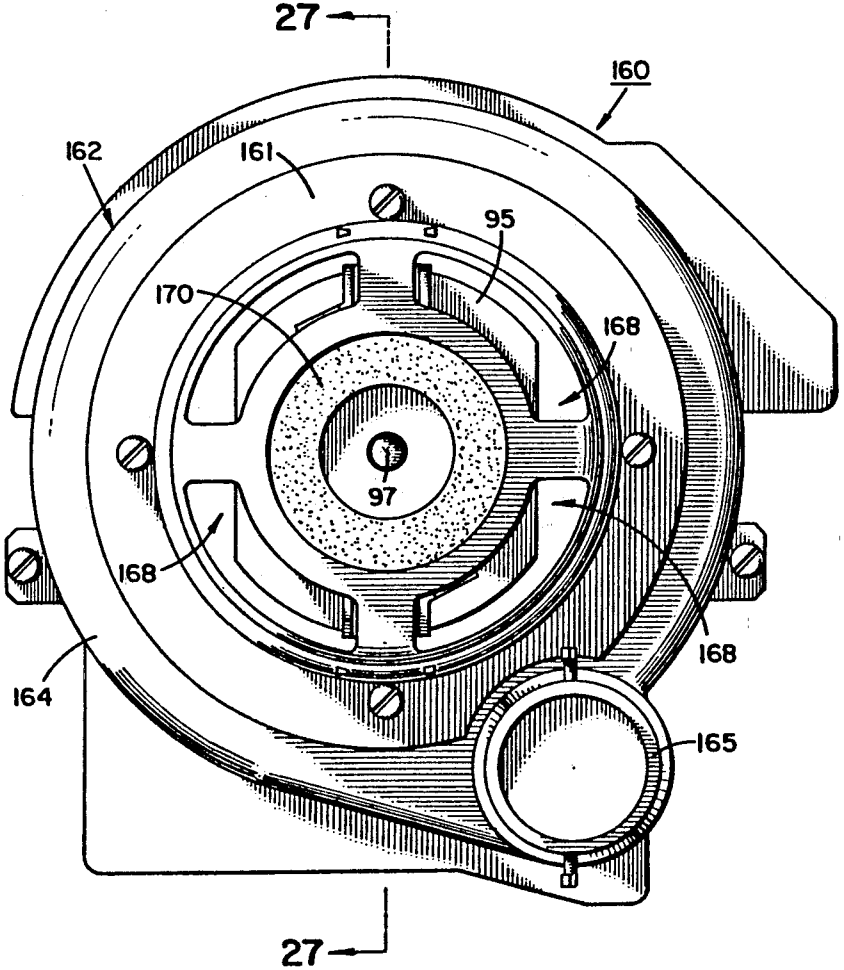
FIG. 26 is an end view of an alternate embodiment of the motor assembly of the present invention.

In FIGS. 26 and 27, an alternate motor assembly construction is depicted. In this construction, motor assembly 160 comprises a conventional electrical motor 95 which is retained within motor housing 161. As with the previous embodiment, motor housing 161 peripherally surrounds and completely envelopes motor 95 in order to assist in reducing the noise typically associated with motor 95, when activated.

As with the previous embodiment, motor 95 comprises a rotationally driven shaft 97 to which pump fan blade assembly 98 is securely affixed for being rotationally driven thereby. In this embodiment, the positioning of rotationally driven fan assembly 98 is achieved using conventional washers and locking rings.

The construction of motor assembly 160 is completed by peripherally surrounding and enveloping pump fan blade assembly 98 with a fan blade housing 162. Preferably, fan blade housing 162 comprises two matingly interengaged and abutting portions 163 and 164.

In this embodiment, portion 164 of fan blade housing 162 incorporates an inlet portal 166 and an outlet portal 165 integrally formed thereon. In addition, portion 165 also incorporates a plurality of upstanding flanges 176 spaced about inlet portal 166 and positioned for supporting engagement with motor 95.

As clearly shown in FIG. 26, motor housing 161 incorporates a plurality of open zones 168 formed in the end wall of motor housing 161. In this way, air flow through motor housing 161 is easily achieved in order to assure motor 95 is continuously being cooled during its operation.

In the preferred operation of this alternate embodiment, when motor 95 is activated, shaft 97 is rotated causing pump fan blade assembly 98 to rotate therewith. The rotation of pump fan blade assembly 98 causes air to be drawn from outside of motor housing 161 into housing 161 through apertures 168. As the air is drawn through apertures 168, the air flow passes over motor 95, thereby cooling motor 95 as the flow exits through portal 166 into fan blade housing 162. The air flow is then forced by pump fan blade assembly 98 through housing 162 and pumped out from housing 162 through outlet portal 165 to support assembly 21.

By employing this embodiment, conventional cooling fans typically associated with the motor are eliminated and the noise associated with the cooling fans is also eliminated. In addition, motor 95 is able to rotate at a slower speed, thereby further reducing the noise level generated by prior art motors.

Furthermore, by employing this alternate embodiment, it has been found that motor 95 is capable of being completely cooled through its normal operation. By constructing motor housing 161 in the manner detailed above, the motor induced air flow is drawn over the motor prior to being delivered to pump fan blade assembly 98, thereby using this air flow to cool motor 95 during its normal operation.

In addition to being able to achieve a motor which is capable of operating at a slower speed, while also eliminating the need for a cooling fan and the noise associated therewith, this alternate embodiment further reduces the noise level associated with conventional motors by employing a unique mounting construction. In this embodiment, motor 95 is mounted at both of its opposed ends in a completely, suspended arrangement, virtually isolating motor 95 from motor housing 161 and preventing any motor vibration from being transmitted to housing 161.

In this embodiment, the distal end of motor 95 is peripherally surrounded and supportingly held by foam block 170. In the preferred construction, foam block 170 comprises a substantially annular toroidal shape which is retained by a circular flange 171 formed as part of motor housing 161. By employing this construction, the distal end of motor 195 is completely suspended and effectively isolated from housing 161. As a result, any vibration that is caused during the operation of motor 95 is easily absorbed by foam block 170, preventing any transferral of the vibration to housing 161.

In addition, in this embodiment, motor 95 is also supported at its proximal end in a manner which also substantially isolates motor 95 from housing 161, preventing the vibration of motor 95 from being transferred to motor housing 161. As shown in FIG. 27, in the preferred embodiment, the proximal end of motor 95 is supported by mounting foam pads 175 to frame 110 of motor 95, in position for having outwardly extending flanges 176 of portion 164 of pump fan blade housing 162 being brought into mating, supporting contacting engagement with pads 175. In this way, upstanding flanges 176 of fan blade housing 162 extend from the surface of portion 164 into juxtaposed, spaced, cooperating relationship with frame 110 of motor 95. However, by sandwiching foam pads 175 between flanges 176 and frame 110, any vibration of motor 95 during its use is not transmitted to housing 162 by flanges 176. As a result, vibration induced noised is substantially reduced to the point where it is virtually eliminated.

By employing this alternate construction, motor 95 is securely mounted within peripherally surrounding housing 161 for secure, trouble-free operation, while being substantially suspended in its mounted position at both its proximal and distal ends by employing supportingly holding and retaining foam blocks 170 and 175. As a result, any vibration of motor 195 is effectively isolated and absorbed by the foam supporting components, preventing the vibration of motor 95 from being transmitted to motor housing 161 or fan blade housing 162. In this way, the objectionable hum or noise typically associated with an operating motor is virtually eliminated.

Figure 21:
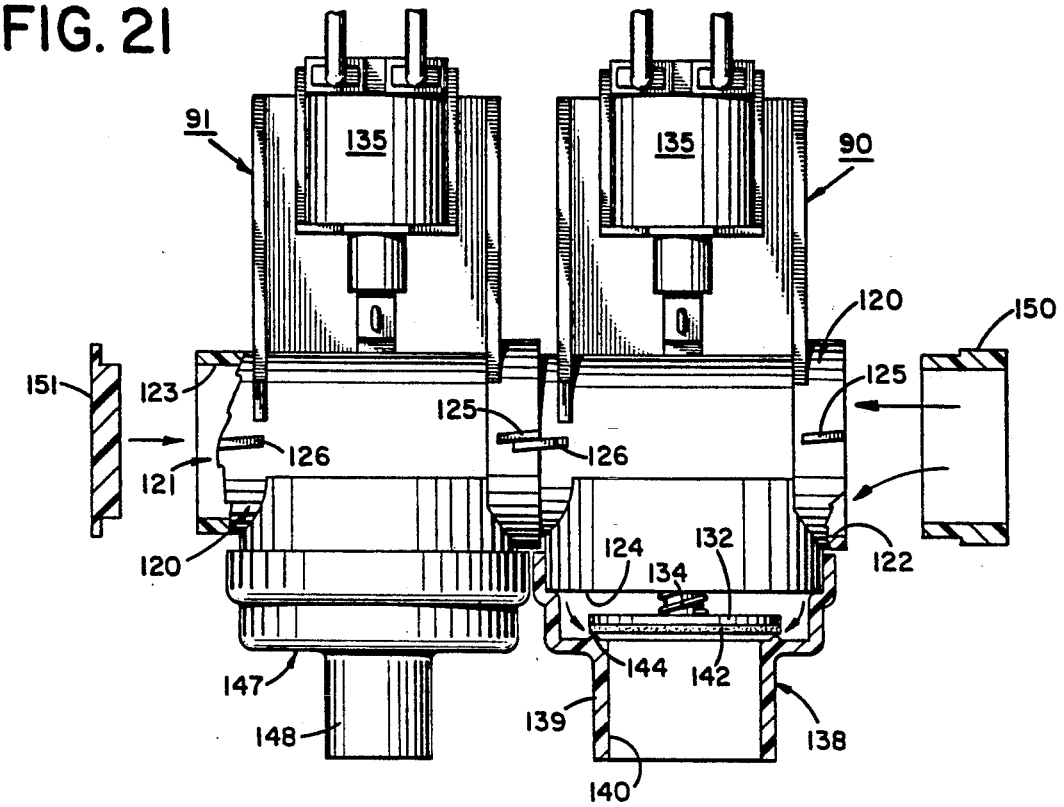
FIG. 21 are top plan views, partially in cross-section and partially broken away, showing the air control valve assemblies which form a part of the air flow control assembly of the present invention.
Figure 22:
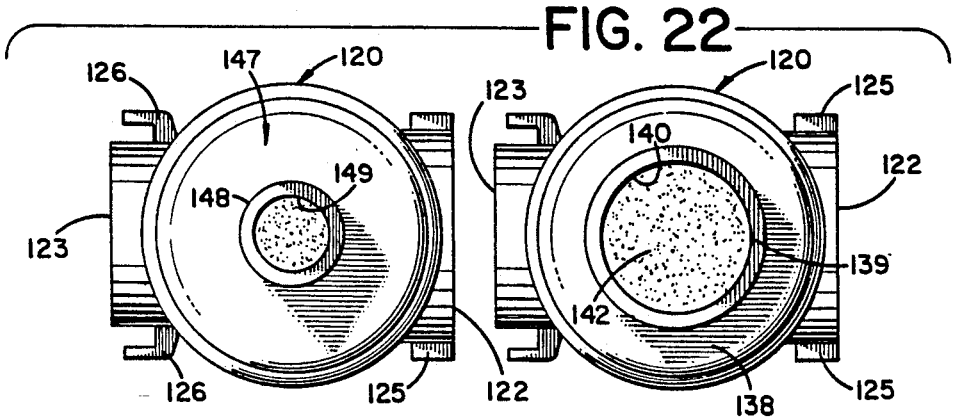
FIG. 22 is a front elevation view of the air control valve assemblies of FIG. 21.
Figure 23:
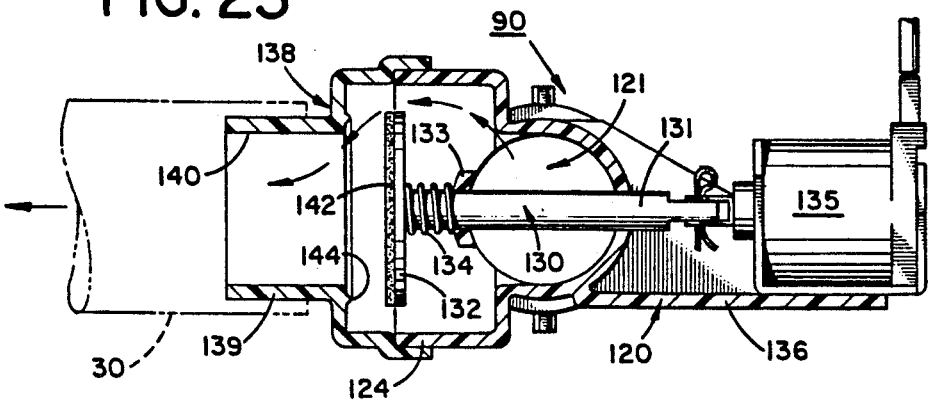
FIG. 23 is a cross-sectional side elevation view of one of the air control valve assemblies of FIG. 21.

By referring to FIGS. 21, 22 and 23, along with the following detailed disclosure, the construction and operation of the unique, highly efficient and comparatively inexpensive air control valve assemblies 90 and 91 can best be understood. In addition, as will be apparent from this disclosure, the air control valve assemblies 90 and 91, along with their associated components, are capable of providing a dependable, repeatable, safe and efficient controlled movement of the unitary, portable, support assembly 21 of this invention.

In the preferred embodiment, air control valve assemblies 90 and 91 are constructed by employing an identically sized and shaped housing 120. Housing 120 incorporates an interior chamber 121 which communicates with an inlet portal 122, a first outlet portal 123, and a second outlet portal 124.

Preferably, portal 123 and portal 122 are dimensioned for mating, locking, frictional interengagement with each other. In this preferred construction, portal 123 comprises an outer diameter substantially equivalent to the inner diameter of portal 122. As a result, two identically shaped housings 120, 120 are quickly and easily interconnected with each other by merely inserting portal 123 into portal 122. In addition, each housing 120 preferably incorporates upstanding tabs 125 positioned about portal 122 and upstanding tabs 126 positioned about portal 123. As depicted in FIG. 21, when two housings 120 are mounted in secure, frictional interengagement with each other, tabs 125 and 126 are placed in abutting contact with each other, thereby assuring that housings 120, 120 are oriented in the precisely desired position.

Each housing 120 is constructed to receive air flow through portal 122 and allow the air to flow through interior chamber 121, exiting through outlet portals 123 and 124. As a result, when two housings 120, 120 are mounted in secure, frictional interengagement with each other, as depicted in FIG. 21, air flowing into the first housing 120 through open portal 122 will be able to pass through interior chamber 121 of the first housing 120 as well as through interior chamber 121 of the second housing by exiting outlet portal 123 of the first housing and simultaneously entering inlet portal 122 of the second housing 120.

In this way, any desired number of housings can be quickly and easily matingly interconnected with each other to provide any desired number of air controlled valve assemblies 90 and 91. As a result, the desired controlled air flow for a single support assembly or a double support assembly can be achieved quickly, easily, and comparatively inexpensively.

In order to attain the desired, fully controllable valve assembly 90 or 91, each valve assembly incorporates a piston 130 which comprises an elongated rod 131 which terminates at one end thereof with a substantially flat plate 132. In the preferred embodiment, elongated piston rod 131 is axially movable within housing 120, supported for this axial movability by support arm 133.

In addition, spring means 134 is positioned on elongated rod 131 between support arm 133 and plate 132. In this way, spring means 134 continuously biases piston 130 with plate 132 being continuously maintained in its fully extended, forwardmost position, outwardly from portal 124.

In order to enable piston 130 to be axially movable, from its fully extended position (FIG. 21) to its fully retracted position (FIG. 23), the opposed end of rod 131 is affixed to solenoid 135. In this construction, whenever solenoid 135 is activated, piston 130 is drawn toward solenoid 135 along the axis of rod 131, causing plate 132 to be moved into biasing, compressing engagement of spring means 134 between plate 132 and support arm 133.

In order to complete the construction of air control valve assembly 90, a portal cover 138 is mounted in secure, sealed interengagement with portal 124 of housing 120. In addition, portal cover 138 incorporates a tubular extension 139 integrally formed therewith which incorporates a centrally disposed portal 140. Portal 140 of tubular extension 139 is completely unobstructed, communicating directly with portal 124 of housing 120. In this way, outlet 124 of housing 120 is effectively extended to portal 140.

In the preferred embodiment, tubular extension 139 comprises an outer diameter which is constructed for mating, secure mounted interengagement with air delivery hose 30. When hose 30 is mounted to tubular extension 139, the air exiting portal 124 of housing 20 is delivered to hose 30 for filling bladder control frame system 35.

In its preferred construction, plate 132 of piston 130 incorporates a soft, compressible layer 142 of air sealing material. In addition, portal cover 138 is dimensioned to assure that the inside surface of portal cover 138 is continuously maintained in secure, contacting interengagement with compressible layer 142 when piston 130 is in its normal, spring biased forward position. In this way, when solenoid 135 is not activated, portal 140 is normally maintained in a closed or sealed configuration, preventing any air from flowing into hose 30. This position is clearly shown in FIG. 21.

In addition, in order to further enhance and provide a safe, dependable, sealed closure of portal 40, portal cover 138 incorporates an upstanding circular ridge 144 formed on the inside surface thereof for mating, contacting, sealing interengagement with compressible sealing layer 142. In this way, the desired, sealed closure of portal 140 is assured.

As detailed herein, the construction of air control valve assembly 90 and air control valve assembly 91 are virtually identical, in order to obtain the cost reduction benefits realized by standardized, identical parts. As a result, air control valve assembly 91 is constructed virtually identical to the construction detailed above in reference to air control valve assembly 90. The only structural differences incorporated into air control valve assembly 91 is the use of a portal cover 147 which differs only in tubular extension 148 being constructed with a smaller diameter than tubular extension 139. Similarly, portal 149 defined by tubular extension 148 also comprises a smaller diameter.

Due to the fact that the air flow required for inflating panel member 36 is substantially less than the air flow required for inflating bladder control frame system 35, the air delivery hose 31 comprises a smaller diameter than air delivery hose 30. As a result, tubular extension 148 comprises an outer diameter which corresponds to the inner diameter of hose 31, in order to enable hose 31 to be securely affixed to extension 148, thereby providing the desired air flow.

Since the exit portal 149 of portal cover 148 is smaller than the exit portal of cover 138, the piston plate cooperating with portal cover 147 also preferably comprises a smaller diameter. In this way, all of the component parts associated with portal cover 147 comprise cooperating dimensions. However, their construction and operation is identical to the construction and operation detailed above in reference to portal cover 138.

In order to attain a quickly and easily assembled construction wherein the air exiting from portal 104 of fan housing 100 is efficiently delivered to support assembly 21, a simple interconnecting boss 150, shown in FIG. 21, is employed. Boss 150 is dimensioned for secure, frictional interengagement with portal 122 of housing 120 while the opposed end of boss 150 is constructed for secure, frictional, locked interengagement with exit portal 104 of fan housing 100. In this way, the air exiting through exit portal 104 is efficiently delivered directly to air control valve assemblies 90 and 91.

The final component required in order to complete this construction is plug 151 shown in FIG. 21. Plug 151 is inserted in portal 123 of air control valve assembly 91 in order to prevent any air from flowing out of portal 123. In this way, assurance is provided that the air flow is properly channeled only to the desired locations, and no air flow is lost to unwanted open portals.

As is now apparent from the preceding detailed disclosure, the present invention attains an air flow control assembly 22 which is comparatively inexpensively manufactured while being capable of delivering all of the desired air flow to a single, unitary support assembly 21 of this invention. In addition, if two support assemblies 21 are desired, additional housings 120 are mounted to air control valve assemblies 90 and 91 in order to attain a second set of identically constructed air control valve assemblies 90 and 91. In this way, a second unitary support assembly can be efficiently and independently controlled without requiring a separate motor and without requiring expensive complicated air flow controlling components.

Using conventional, well-known wiring techniques and switch means, motor 95 and solenoids 135 are connected to operate on conventional, household current. In addition, the control means detailed above are connected to motor 95 and solenoids 135 using conventional, well-known techniques and hardware to attain activation and deactivation whenever desired. In the preferred construction, each control means has two separate rocker switches which are normally maintained in the off position. One rocker switch is employed to operate the inflation and deflation of bladder control frame assembly 35, while the other rocker switch is constructed to operate the inflation and deflation of panel member 36.

When the activation of bladder control frame assembly 35 is desired, one of the rocker switches would be pressed which is connected to cause motor 95 to be activated while also causing solenoid 135 of air control valve assembly 90 to be activated. As a result, solenoid 135 causes piston 130 to be moved out of sealed interengagement with ridge 144 of portal cover 138, thereby opening portal 140.

The air flow caused by the operation of motor 95 and its associated fan blade assembly causes air to enter air control valve assembly 90 and exit through portal 140 into hose 30. As previously detailed, hose 30 is connected directly to air control frame assembly 35. As a result, all of the air flow caused by the operation of motor 95 is directed into bladder control frame system 35, causing frame member 50 to arcuately pivot relatively to frame member 51. As frame member 50 pivots, the back supporting portion of support assembly 21 is elevated into the precisely desired position.

Once the desired position has been reached, the user merely removes activation pressure from the rocker switch, thereby causing the rocker switch to automatically go back to the off position. Once in the off position, motor 95 is stopped and solenoid 135 is deactivated, causing piston 130 to return into sealed interengagement with ridge 144 of cover 138.

Due to the forces caused by spring 134 of air control valve assembly 90, piston 130 sealingly closes portal 140, preventing any air flow either into hose 30 from interior chamber 121 or into interior chamber 121 from hose 30. As a result, the desired elevated position of support assembly 21 is maintained.

Whenever deflation of support assembly 21 is desired, the user merely presses the rocker switch into its alternate active position which causes solenoid 135 of air control valve assembly 90 to be activated, opening portal 140. Once open, all of the air in bladder control frame assembly 35 is able to escape back into the atmosphere through portal 140 into valve housing 120, out of housing 120 through portal 122 and into fan blade housing 100. The air then exists from fan blade housing 100 through portal 103, thereby allowing the air to exit directly into housing 80. With housing 80 being in continuous communication with the outside air through enlarged cut out zones 89, the air from bladder control frame assembly 35 simply, easily, and automatically exits through the delivery system back to ambient surroundings.

As previously discussed in detail, the elastic forces of shroud 37 places compressive forces on bladder control frame assembly 35, thereby causing bladder 52 of bladder control frame assembly 35 to be forced into its deflated position, simultaneously forcing all of the air contained within bladder 52 outwardly through hose 30, valve assembly 90, fan blade housing 100 and housing 80. During the inflation of bladder controlled frame assembly 35, no inflation of panel member 36 is realized, since portal 149 of portal cover 147 is maintained in sealed interengagement. Consequently, flow through portal 149 into hose 31 is prevented.

Whenever the user desires inflation of panel member 36, the second switch of the control means is pressed into its first active position which is constructed for powering motor 95 and solenoid 135 of air control valve assembly 91. In a similar manner detailed above, the activation of solenoid 135 of air control valve assembly 91 causes the piston associated therewith to be retracted from sealing engagement with portal 149, opening portal 149 to the air flow caused by the operation of motor 95. Consequently, air is delivered through portal 149 to hose 31 and into panel member 36, to cause the desired inflation thereof.

Although the air flowing through portal 149 from fan blade housing 100 has first passed through air control valve assembly 90, no air flow through portal 140 to the bladder controlled frame system 35 is possible since piston 130 is maintained in secure, sealed, biased engagement with portal cover 138, thereby sealing portal 140 and preventing any air flow therethrough.

Once the panel member 36 has been inflated to the desired level, the user merely removes the activation force from the rocker switch, which automatically stops motor 95 from operating and causes the piston of air control valve assembly 91 to be returned into sealed, closing engagement with cover 147. This position is then maintained as long as the user desires.

Once deflation of panel member 136 is sought, the rocker switch is moved into its alternate active position, which causes solenoid 135 to move the piston associated therewith to move into the open position, thereby allowing all of the air within panel member 136 to be forced in the reverse direction through portal 149, air control valve assembly 90 and 91, blade housing 100, and housing 80.

It has been found that no motor driven suction is required to withdraw the air from either bladder control frame assembly 35 or panel member 36. As detailed above, the elastic forces of shroud 37 are sufficient to assure that the bladder control frame assembly is completely deflated, when desired, without requiring expensive operational components. Similarly, by the user merely maintaining his legs in position on support assembly 21, air within panel member 36 is easily forced through the open passageway detailed above, until fully deflated. Of course, once the panel member has been fully deflated, the user merely removes the activation force from the rocker switch, causing the rocker switch to move into its normally off position and simultaneously causing the piston of air controlled valve assembly 91 to be moved by the spring means associated therewith into its sealed engagement with portal cover 147.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings have been interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A portable, integrated, universally adjustable position controlling system for enabling users to position a back-supporting portion thereof into any one of a plurality of alternate positions, said position controlling system comprising:

A. a first, portable, self-contained, unitary, movably adjustable support assembly comprising
   a. a support pad for comfortably supporting the user;
   b. cover means peripherally surrounding and enveloping substantially the entire support pad;
   c. position control means
      1. securely mounted between the support pad and the cover means in movement controlling relationship with a portion of the support pad;
      2. constructed for moving the support pad through an arcuate distance of about 80° and securely supportingly maintaining the support pad in any position between 0° and 80°, and 3. responsive to a control signal to arcuately move the support pad away from a portion of the cover means until a desired raised position is reached and maintain the support pad in the raised position;

d. shroud means cooperatively associated with the cover means in peripherally surrounding, enclosing, visually obscuring relationship with the support pad and at least a portion of the position control means maintaining the position control means in contact with the support pad throughout the entire arcuate movement thereof;

B. control means connected to an air flow control assembly for providing a control signal and transmitting the control signal to an air flow control assembly; and C. an air flow control assembly a. constructed for drawing air from the ambient surroundings and delivering a continuous air flow to the position control means of the first support assembly for causing said position control means to arcuately pivot, and b. incorporating valve means responsive to the control signal for selectively opening and closing air flow passageways incorporated therein for assuring the delivery of the air flow to the desired location;

whereby a completely integrated, portable, position-controlling system is attained which is capable of being easily transported to any desired location and placed on any desired support surface for providing the user with complete adjustable movement of the support assembly by employing the air flow control assembly connected therewith.

2. The portable, self-contained, unitary, movably adjustable support assembly defined in claim 1, wherein said assembly further comprises:

D. an inflatable panel mounted between the support pad and the cover means at an end of the pad opposite from the position control means and comprising a. two independent chambers in air communicating interengagement with each other and constructed for expanding upon being filled with air, and b. portal means mounted to each of said chambers for delivering air thereto.

3. The portable, integrated, universally adjustable position controlling system defined in claim 1, and further comprising D. a second portable, self-contained, unitary, movably adjustable support assembly comprising a. a support pad for comfortably supporting the user;

b. cover means peripherally surrounding and enveloping substantially the entire support pad;

c. position control means 1. securely mounted between the support pad and the cover means in movement controlling relationship with a portion of the support pad;

2. constructed for moving the support pad through an arcuate distance of about 80° and securely supportingly maintaining the support pad in any position between 0° and 80°, and 3. responsive to a control signal to arcuately move the support pad away from a portion of the cover means until a desired raised position is reached and maintain the support pad in the raised position;

d. shroud means cooperatively associated with the cover means in peripherally surrounding, enclosing, visually obscuring relationship with the support pad and at least a portion of the position control means maintaining the position control means in contact with the support pad throughout the entire arcuate movement thereof; and the air flow control assembly is further defined as also delivering air flow to the position control means of the second support assembly, thereby providing a fully integrated, position controlling system, whereby activation of the control means causes air to flow to one of the support assemblies for raising that support assembly to the desired position completely independently of the second support assembly.

4. A portable, self-contained, unitary, movably adjustable support assembly for enabling users to position a back-supporting portion thereof and/or a leg-supporting portion thereof into any one of a plurality of alternate positions, said support assembly comprising:

A. a support pad for comfortably supporting the user;

B. cover means peripherally surrounding and enveloping substantially the entire support pad;

C. position control means a. securely mounted between the support pad and the cover means in movement controlling relationship with a portion of the support pad;

b. constructed for moving the support pad through an arcuate distance of about 80° and securely supportingly maintaining the support pad in any position between 0° and 80°, and c. responsive to a control signal to arcuately move the support pad away from a portion of the cover means until a desired raised position is reached and maintain the support pad in the raised position; and D. a shroud a. securely affixed to the cover means in peripherally surrounding, enclosing, visually obscuring relationship with the support pad and the position control means;

b. expandable from a small, compact configuration to a fully extended, open, exposed position, peripherally surrounding and visually obscuring the position control means throughout its arcuate movement of the support pad, and c. retractably collapsible from its fully extended position to its compact position when desired, as the position control means is moved into its original position, whereby a completely portable, support assembly is achieved which is aesthetically pleasing, neat, and compact, while also being universally adjustable into any desired position in any desired location.

5. The portable, self-contained, unitary movably adjustable support assembly defined in claim 4, wherein said position control means is further defined as comprising:

d. two U-shaped frame members constructed for nested interengagement with each other when pivotally interconnected at their respective terminating ends, e. an air inflatable bladder 1. independently interconnected with each of said frame members on adjacent surfaces thereof, and 2. incorporating a sealed, air retaining zone formed therein, f. frame retaining means affixed to adjacent surfaces of the bladder and positioned for secure retained engagement with portions of each of the frame members, thereby assuring controlled independent movement of each of the frame members, while also preventing unwanted shifting of the bladder relative to the frame members, and g. air receiving portal means interconnected at a first end thereof in one surface of the bladder for communicating with the sealed, air-retaining zone therein, with a second end of the portal means being constructed for interconnection with air delivery means, whereby upon receipt of air through said portal means, the air retaining zone of said bladder inflates, causing at least one frame member to arcuately pivot relative to the other frame member.

6. The portable, unitary, adjustable support assembly defined in claim 5, wherein at least one of said frame members is further defined as comprising a plurality of support straps, each being securely affixed at its opposed ends to juxtaposed, spaced, facing portions of the frame member, providing a support surface for resisting any weight placed thereon, while also maintaining the bladder in a substantially flat configuration during inflation and use.

7. The portable, unitary, adjustable support assembly defined in claim 5, wherein the frame retaining means are further defined as comprising sleeves affixed to the adjacent surfaces of the bladder and positioned for securely retaining and supportingly holding a particular portion of one of said frame members.

8. The portable, unitary, adjustable support assembly defined in claim 5, wherein the frame retaining means are further defined as comprising a plurality of elongated straps securely affixed to adjacent surfaces of the bladder with each strap comprising frame retaining loops formed at each terminating end for securely retaining and supportingly holding a portion of one of said frame members.

9. A portable, self-contained, unitary, movably adjustable support assembly for enabling users to position a back-supporting portion thereof and/or a leg-supporting portion thereof into any one of a plurality of alternate positions, said support assembly comprising:

A. a support pad for comfortably supporting the user;

B. cover means peripherally surrounding and enveloping substantially the entire support pad;

C. position control means a. securely mounted between the support pad and the cover means in movement controlling relationship with a portion of the support pad;

b. constructed for moving the support pad through an arcuate distance of about 80° and securely supportingly maintaining the support pad in any position between 0° and 80°, and c. responsive to a control signal to arcuately move the support pad away from a portion of the cover means until a desired raised position is reached and maintain the support pad in the raised position; and D. a shroud a. incorporating elastic material for continuously biasing the shroud into a small, compact configuration, b. securely affixed to the cover means in peripherally surrounding, enclosing, visually obscuring relationship with the support pad and the position control means;

c. expandable from its small, completely compact configuration to a fully extended, open, exposed position, peripherally surrounding and visually obscuring the position control means throughout its entire arcuate movement of the support pad, and d. automatically retracting from its fully extended position to its compact position when desired, with said elastic material causing the shroud and the peripherally surrounded and enclosed position control means to be moved into their original position, whereby a completely portable, support assembly is achieved which is aesthetically pleasing, neat, and compact, while also being universally adjustable into any desired position in any desired location.

10. The portable, self-contained, unitary movably adjustable support assembly defined in claim 9, wherein said position control means is further defined as comprising:

e. two U-shaped frame members constructed for nested interengagement with each other when pivotally interconnected at their respective terminating ends, f. an air inflatable bladder 1. independently interconnected with each of said frame members on adjacent surfaces thereof, and 2. incorporating a sealed, air retaining zone formed therein, g. frame retaining means affixed to adjacent surfaces of the bladder and positioned for secure retained engagement with portions of each of the frame members, thereby assuring controlled independent movement of each of the frame members, while also preventing unwanted shifting of the bladder relative to the frame members, and h. air receiving portal means interconnected at a first end in one surface of the bladder for communicating with the sealed, air-retaining zone therein, with a second end of the portal means being constructed for interconnection with air delivery means, whereby upon receipt of air through said portal means, the air retaining zone of said bladder inflates, causing at least one frame member to arcuately pivot relative to the other frame member.

11. The portable, unitary, adjustable support assembly defined in claim 10, wherein the U-shaped frame members are further defined as being dimensioned for nested interengagement with each other with an enlarged spacing formed therebetween when in their nested position, thereby preventing any accidental pinching or squeezing capture of small objects therebetween.

12. The portable, unitary, adjustable support assembly defined in claim 10, wherein at least one of said frame members is further defined as comprising a plurality of support straps, each being securely affixed at its opposed ends to juxtaposed, spaced, facing portions of the frame member, providing a support surface for resisting any weight placed thereon, while also maintaining the bladder in a substantially flat configuration during inflation and use.

13. The portable, unitary, adjustable support assembly defined in claim 10, wherein the frame retaining means are further defined as comprising sleeves affixed to the adjacent surfaces of the bladder and positioned for securely retaining and supportingly holding a particular portion of one of said frame members.

14. The portable, unitary, adjustable support assembly defined in claim 10, wherein the frame retaining means are further defined as comprising a plurality of elongated straps securely affixed to adjacent surfaces of the bladder with each strap comprising frame retaining loops formed at each terminating end for securely retaining and supportingly holding a portion of one of said frame members.

15. The portable, self-contained, unitary, movably adjustable support assembly defined in claim 10, further comprising E. an air flow control assembly
  a. constructed for drawing air from the ambient surroundings and delivering a continuous air flow to the air receiving portal means of the position control assembly, and
  b. incorporating valve means responsive to a control signal for selectively opening and closing air flow passageways for assuring the delivery of the air flow to the desired location; and F. control means connected to the air flow control assembly for providing a control signal and transmitting the control signal to the air flow control assembly, whereby a completely integrated, portable, position-controlling system is attained which is capable of being easily transported to any desired location and placed on any desired support surface for providing the user with complete adjustable movement of the support assembly by employing the air flow controlled assembly connected therewith.

16. The portable, self-contained, unitary, movably adjustable support assembly defined in claim 15, wherein said assembly further comprises:

G. an inflatable panel mounted between the support pad and the cover means at an end of the pad opposite from the position control means and comprising
  a. two independent chambers in air communicating interengagement with each other and constructed for expanding upon being filled with air, and
  b. portal means mounted to each of said chambers for delivering air thereto.

17. The portable, unitary support assembly defined in claim 15, wherein said assembly further comprises G. an inflatable panel comprising
  a. two independent sheets of air impervious material positioned in juxtaposed, spaced, overlying contacting engagement with each other, the abutting surfaces of said sheets being heat sealed to each other along a continuous line, said line defining a dual chambered air-receiving zone, with each of said dual chambers comprising an overall size and shape, when inflated, defined by
    1. a central, substantially cylindrically shaped portion and
    2. two conical shaped portions each having the base thereof extending from opposite sides of the centrally disposed, substantially cylindrically shaped portions, with each of said conical shaped portion terminating with a smoothly rounded apex.

whereby a dual chamber configuration is attained which assures rapid and efficient filling thereof with optimum air distribution and retention for elevating the support pad above the surface on which the pad is retained, thereby providing an extremely efficient and comfortable leg supporting and raising portion.

18. The portable, unitary, support assembly defined in claim 17, wherein said inflatable panel is further defined as being securely affixed to the cover means along at least the side edges of said inflatable panel, thereby preventing unwanted shifting movement of the panel and assuring trouble-free operation thereof.

19. The poratable, unitary, support assembly defined in claim 17, wherein said assembly further comprises H. strap means
  a. securely affixed to the cover means at the terminating ends thereof associated with the inflatable panel member, and
  b. constructed for peripherally surrounding a conventional mattress and maintaining the ends of said support assembly in secure contacting engagement with said mattress, thereby preventing unwanted lifting of the ends of the support pad from the mattress during the inflation of the panel member.

20. The portable, self-contained, unitary support assembly defined in claim 15, wherein said support assembly further comprises H. elongated strap means securely affixed to opposed ends of one of said U-shaped frame members with the strap means being constructed for fastening interengagement along its length, thereby providing strap means for securely affixing the support assembly to a mattress, when so desired, in order to prevent unwanted shifting movement of the support assembly while positioned on the mattress.

21. The portable, self-contained, unitary, adjustable support assembly defined in claim 15, wherein said air flow control assembly is further defined as comprising:

a. a motor assembly
  1. constructed for drawing air from the ambient surroundings, and
  2. delivering a continuous flow of air to an outlet portal associated therewith, b. a first valve assembly,
  1. comprising at least two portals, one of said portals being connected to the outlet portal of the motor assembly for receiving the air flow therefrom,
  2. piston means
    i. mounted in cooperating, sealing interengagement with the second portal,
    ii. constructed for normally being biased into a portal closing position, and
    iii. responsive to an actuation signal for moving the piston means from its normal portal closed position to a portal open position, thereby allowing air flow from the motor assembly to pass through said first valve assembly.

22. The portable, self-contained, unitary, adjustable support assembly defined in claim 16, wherein said air flow control assembly is further defined as comprising:

a. a motor assembly
  1. constructed for drawing air from the ambient surroundings, and
  2. delivering a continuous flow of air to an outlet portal associated therewith, b. a first valve assembly, 1. comprising three portals, one of said portals being connected to the outlet portal of the motor assembly for receiving the air flow therefrom, and
2. piston means
   i. mounted in cooperating, sealing interengagement with a second of said portals,
   ii. constructed for normally being biased into a portal closing position, and
   iii. responsive to an actuation signal for moving the piston means from its normal portal closed position to a portal open position, thereby allowing air flow from the motor assembly to pass through said first valve assembly; and c. a second valve assembly
1. comprising at least two portals, one of said portals being connected to the third portal of the first valve assembly for receiving the air flow therefrom, and
2. piston means
   i. mounted in cooperating, sealing interengagement with a second of said portals,
   ii. constructed for normally being biased into a portal closing position, and
   iii. responsive to an actuation signal for moving the piston means from its normal portal closed position to a portal open position, thereby allowing air flow from the motor assembly to pass through said first valve assembly.

23. The portable, self-contained, unitary, adjustable support assembly defined in claim 22, wherein said first valve assembly and said second valve assembly are further defined as comprising substantially identical, matingly interlocking constructions and said second valve assembly comprises plug means for sealing the third portal to prevent unwanted air flow therethrough.

24. The portable, unitary, support assembly defined in claim 22, wherein each of said valve assemblies are further defined as comprising a valve portal covering cap constructed for peripherally surrounding and sealingly enclosing the second portal of the valve assembly and comprising
i. a portal formed in said cap for enabling the air flow delivered to the second portal to pass therethrough,
ii. a substantially circular ridge extending from a surface of the cap peripherally surrounding the portal of the cap and positioned for secure, abutting, contacting interengagement with a surface of the piston means in order to provide the sealing closure of the second portal when the piston is in its first, normal biased position, and
iii. nipple means extending from the outside surface of the cover and forming an air flow controlling and conducting conduit zone through which the air flowing through the portal of the cover is capable of freely passing when the piston means is in the open position.

25. The portable, unitary, support assembly defined in claim 24, wherein said piston means are further defined as comprising a layer of soft, compressible, air impervious material forming a contacting surface thereof, mounted for cooperative sealing interengagement with the upstanding ridge of the cap, thereby assuring complete closure of said second portal of each of the valve assemblies whenever the piston means is in its normally biased, closed position.

26. The portable, unitary, adjustable support assembly defined in claim 21, wherein said motor assembly is further defined as comprising
3. a motor and fan construction,
4. housing means peripherally surrounding the motor and fan construction for peripherally surrounding and enclosing the motor and the fan reducing the noise generated by vibration, and
5. soft, compressible, cushioning material affixed to the housing and mounted in supporting interengagement with the fan and motor assembly for supportingly interconnecting the fan motor to the housing, whereby vibration transmission to the housing is absorbed by the foam block and the noise created thereby is virtually eliminated.

27. The portable, unitary, support assembly defined in claim 26, wherein said motor assembly is further defined as comprising separate motor surrounding housing and a separate fan blade assembly surrounding and enclosing housing with said two housings securely affixed to each other and said foam block is further defined as being mounted to the surface of the fan blade housing to which the motor housing is affixed, thereby providing a secure, supporting, holding interengagement of the motor about its rotating shaft in an optimum balanced location.

28. A portable, integrated, universally adjustable position controlling system comprising
A. at least one portable, self-contained, unitary, adjustable support assembly comprising
   a. an elongated support pad for comfortably supporting the user;
   b. cover means peripherally surrounding and enveloping substantially the entire support pad;
   c. position control means
      1. securely mounted between the support pad and the cover means in movement controlling relationship with a portion of the support pad;
      2. constructed for moving the support pad through an arcuate distance of about 80° and securely supportingly maintaining the support pad in any position between 0° and 80°, and
      3. responsive to a control signal to arcuately move the support pad away from a portion of the cover means until a desired raised position is reached and maintain the support pad in the raised position;
      4. two U-shaped frame members constructed for nested interengagement with each other when pivotally interconnected at their respective terminating ends,
      5. an air inflatable bladder
         i. independently interconnected with each of said frame members on opposed surfaces thereof, and
         ii. incorporating a sealed, air retaining zone formed therein,
      6. a plurality of frame retaining sleeves affixed to opposed surfaces of the bladder and positioned for securely retaining and supportingly holding each of the frame members therein, assuring controlled independent movement of each of the frame members, while also preventing unwanted shifting of the bladder relative to the frame members, and
      7. air receiving portal means interconnected at a first end thereof in one surface of the bladder for communicating with the sealed, air-retaining zone therein, with a second end of the portal means being constructed for interconnection with air delivery means, d. a shroud
1. incorporating elastic material for continuously biasing the shroud into a small, compact configuration,
2. securely affixed to the cover means in peripherally surrounding, enclosing, visually obscuring relationship with the support pad and the position control means;
3. expandable from its small, completely compact configuration to a fully extended, open, exposed position, peripherally surrounding and visually obscuring the position control means throughout its entire arcuate movement of the support pad, and
4. automatically retracting from its fully extended position to its compact position when desired, with said elastic material causing the shroud and the inflatable bladder of the peripherally surrounded and enclosed position control means to be moved into their original position, and e. an inflatable panel mounted between the support pad and the cover means at an end of the pad opposite from the position control means and comprising
1. two independent chambers in air communicating interengagement with each other and constructed for expanding upon being filled with air, and
2. conduit means mounted to each of said chambers for delivering air thereto;

B. an air flow control assembly comprising:
a. a motor assembly
1. constructed for drawing air from the ambient surroundings, and
2. delivering a continuous flow of air to an outlet portal associated therewith, b. a first valve assembly,
1. comprising at least two portals, one of said portals being connected to the outlet portal of the motor assembly for receiving the air flow therefrom,
2. piston means
i. mounted in cooperating, sealing interengagement with the second portal,
ii. constructed for normally being biased into a portal closing position, and
iii. responsive to an actuation signal for moving the piston means from its normal portal closed position to a portal open position, thereby allowing air flow from the motor assembly to pass through said first valve assembly; and c. a second valve assembly
1. comprising at least two portals, one of said portals being connected to a third portal of the first valve assembly for receiving the air flow therefrom,
2. piston means
i. mounted in cooperating, sealing interengagement with a second of said portals,
ii. constructed for normally being biased into a portal closing position, and
iii. responsive to an actuation signal for moving the piston means from its normal portal closed position to a portal open position, thereby allowing air flow from the motor assembly to pass through said second valve assembly;

C. control means connected to the air flow control assembly for providing a control signal and transmitting the control signal to the air flow control assembly; and D. air flow conducting conduit means connected at one end to the second outlet portal of the first and second valve housings and connected at its opposed end to the air inflatable bladder and the conduit means of the panel, thereby providing a fully integrated, position controlling system, whereby user activation of the control means causes air to flow directly to the bladder assembly and/or the panel member for raising the support assembly to the desired position.

29. The portable, integrated, universally adjustable position control system defined in claim 28, wherein said system comprises two self-contained, unitary, adjustable support assemblies, each being controllably movable independently of the other said control means are further defined as comprising two separate units for independently controlling the movement of each of the two support assemblies, and said air flow control assembly is further defined as comprising d. a third valve assembly,
1. comprising at least two portals, one of said portals being connected to a third portal of the second valve assembly for receiving the air flow therefrom,
2. piston means
i. mounted in cooperating, sealing interengagement with the second portal,
ii. constructed for normally being biased into a portal closing position, and
iii. responsive to an actuation signal for moving the piston means from its normal portal closed position to a portal open position, thereby allowing air flow from the motor assembly to pass through said third valve assembly; and c. a fourth valve assembly
1. comprising at least two portals, one of said portals being connected to a third portal of the first valve assembly for receiving the air flow therefrom,
2. piston means
i. mounted in cooperating, sealing interengagement with a second of said portals,
ii. constructed for normally being biased into a portal closing position, and
iii. responsive to an actuation signal for moving the piston means from its normal portal closed position to a portal open position thereby allowing air flow from the motor assembly to pass through said fourth valve assembly; and said air flow conducting conduit means are further defined as connected at one end to the second outlet portal of the third and fourth valve housings and connected at its opposed end to the air inflatable bladder and the conduit means of the panel of the second support assembly, thereby providing a fully integrated, position controlling system, whereby user activation of either one of the control means causes air to flow directly to the bladder assembly and/or the panel member of one of the support assemblies for raising that support assembly to the desired position completely independently of the second support assembly.

30. The portable, integrated, universally adjustable position controlling system defined in claim 29, wherein said fourth valve assemblies of the air flow control assembly are further defined as comprising substantially identical, matingly interlocking constructions.

31. A motor assembly constructed for minimizing the noise level associated with an operating motor, said assembly comprising A. an electric motor incorporating an elongated rotationally driven shaft extending therefrom;

B. a pump fan blade assembly mounted to the shaft of the motor for being rotationally driven thereby;

C. housing means comprising a. a motor housing portion peripherally surrounding and substantially enclosing the motor, b. a fan blade housing portion peripherally surrounding and substantially enclosing the pump fan blade assembly, thereby reducing the noise generated from vibration, and c. said two housing portions being further defined as securely mountable to each other to form a substantially integral configuration and said fan blade housing portion is further defined as comprising 1. an inlet portal formed therein for drawing air from the outside of the fan blade housing into the housing for use by the fan blade assembly, and 2. an outlet portal for directing the air flow exiting from the fan blade assembly and the housing to the desired location; and D. soft compressible cushioning material affixed to the housing and mounted in supporting holding engagement with the fan and motor assembly for supportingly holding and interconnecting the fan and motor assembly to the housing in a manner whereby vibration transmission to the housing is absorbed by the cushioning material, and unwanted noise is substantially eliminated.

32. The motor assembly defined in claim 31, wherein said motor housing portion is further defined as comprising a plurality of air transfer passageways formed therein adjacent the distal end of the motor and the inlet portal to the fan blade assembly housing is further defined as being formed between the pump and the fan blade assembly, whereby the air drawn from the ambient surroundings into the pump fan blade assembly is first drawn through the air transfer passageways formed in the motor housing, thereby causing the air to flow over the motor for cooling the motor during its operation.

33. The motor assembly defined in claim 31, wherein said soft-compressible cushioning material is further defined as being affixed to both the proximal end and the distal end of the motor for suspending and substantially isolating the motor with said cushioning material, thereby assuring that induced noise vibration is virtually eliminated.

* * * * *